US012788094B2

(12) United States Patent
Whyman et al.

(10) Patent No.: US 12,788,094 B2
(45) Date of Patent: Nov. 10, 2026

(54) HELMET

(71) Applicant: Team Wendy LLC, Cleveland, OH (US)

(72) Inventors: Samuel Whyman, Lutherville-Timonium, MD (US); Bryan Stephen Javorek, Novelty, OH (US)

(73) Assignee: TEAM WENDY, LLC, Cleveland, OH (US)

( * ) Notice: Subject to any disclaimer, the term of this patent is extended or adjusted under 35 U.S.C. 154(b) by 0 days.

(21) Appl. No.: 19/033,463

(22) Filed: Jan. 21, 2025

(65) Prior Publication Data

US 2025/0234951 A1 Jul. 24, 2025

Related U.S. Application Data

(60) Provisional application No. 63/623,601, filed on Jan. 22, 2024, provisional application No. 63/623,786, filed on Jan. 22, 2024.

(51) Int. Cl.

| | |
|---|---|
| ***A42B 3/06*** | (2006.01) |
| ***F41H 1/04*** | (2006.01) |
| *F41H 1/08* | (2006.01) |

(52) U.S. Cl.

CPC ..... *A42B 3/06* (2013.01); *A42B 3/063* (2013.01); *F41H 1/04* (2013.01); *A42B 3/062* (2013.01); *F41H 1/08* (2013.01)

(58) Field of Classification Search

CPC ..... A42B 3/06; A42B 3/063; A42B 3/062; A42B 3/128; F41H 1/04; F41H 1/08

See application file for complete search history.

(56) References Cited

U.S. PATENT DOCUMENTS

| | | | | |
|---|---|---|---|---|
| 5,309,576 | A * | 5/1994 | Broersma | A42B 3/128 2/412 |
| 5,867,840 | A * | 2/1999 | Hirosawa | A42B 3/281 2/425 |
| D733,972 | S | 7/2015 | Szalkowski et al. | |
| 9,516,910 | B2 | 12/2016 | Szalkowski et al. | |
| D793,625 | S | 8/2017 | Hauserman et al. | |
| D815,359 | S | 4/2018 | Hauserman et al. | |
| 10,371,487 | B2 | 8/2019 | Hall et al. | |
| 10,912,344 | B2 | 2/2021 | Bohn et al. | |
| 11,337,478 | B2 | 5/2022 | Rogers et al. | |

(Continued)

FOREIGN PATENT DOCUMENTS

| | | |
|---|---|---|
| EP | 3363312 A1 | 8/2018 |
| IN | 202011051786 | 5/2022 |
| WO | 2018169984 A1 | 9/2018 |

*Primary Examiner* — Alissa L Hoey

*Assistant Examiner* — Akwokwo Olabisi Redhead

(74) *Attorney, Agent, or Firm* — Calfee, Halter & Griswold LLP

(57) ABSTRACT

An example of a helmet includes a shell formed from a first material, a recess extending into the shell to a support surface, and an insert formed from a second material. The recess includes a sidewall that extends around a perimeter of the recess. The insert has a shape corresponding to a shape of the recess and a thickness equal to a height of the sidewall of the recess. The insert is attached at least to the support surface and the first material has a first stiffness that is less than a second stiffness of the second material.

20 Claims, 27 Drawing Sheets

(56) References Cited

U.S. PATENT DOCUMENTS

| | | | | |
|---|---|---|---|---|
| 2015/0272257 | A1* | 10/2015 | Pritz | A42B 3/127 2/414 |
| 2016/0007668 | A1* | 1/2016 | Cech | A42B 3/04 2/422 |
| 2020/0337408 | A1* | 10/2020 | Durocher | A42B 3/324 |

* cited by examiner

HELMET

CROSS-REFERENCE TO RELATED APPLICATIONS

The present application claims the benefit of U.S. Provisional Application Ser. No. 63/623,786, filed on Jan. 22, 2024, entitled HELMET LINER, the entire disclosure of which is incorporated herein by reference in its entirety. The present application also claims the benefit of U.S. Provisional Application Ser. No. 63/623,601, filed on Jan. 22, 2024, entitled HELMET, the entire disclosure of which is incorporated herein by reference in its entirety.

TECHNICAL FIELD

The present application relates generally to helmets and in particular to shells for helmets to provide a rigid structure for receiving impacts and distributing the impact force to a helmet liner and the wearer's head.

BACKGROUND

Helmets, such as those used in sporting, industrial, military, and/or outdoor (e.g., mountaineering) environments generally include a shell and a liner. The helmet shell generally provides protection from external impacts and is often configured to spread the impact load across the footprint of the helmet. Helmet liners are generally made from a softer and lower density material than the helmet shell to provide a comfortable fit for the wearer. The helmet liner is configured so that, upon impact, the helmet liner at least partially absorbs and disperses the impact energy. The relatively greater rigidity or stiffness of the shell facilitates the transmission of the force of impact made in one location of the shell to adjacent portions of the shell material. That is, the force of impact remains concentrated in the impact area on a shell made from a more flexible material than a shell that is relatively rigid or stiff.

SUMMARY

This summary is meant to provide examples and is not intended to be limiting of the scope of the invention in any way. For example, any feature included in an example of this summary is not required by the claims, unless the claims explicitly recite the feature.

An example of a helmet includes a shell formed from a first material, a recess extending into the shell to a support surface, and an insert formed from a second material. The recess includes a sidewall that extends around a perimeter of the recess. The insert has a shape corresponding to a shape of the recess and a thickness equal to a height of the sidewall of the recess. The insert is attached at least to the support surface and the first material has a first stiffness that is less than a second stiffness of the second material.

An example of a helmet includes a shell formed from a first material, a recess extending into the shell to a support surface, an insert formed from a second material, and an internal insert formed from a third material. The recess has a sidewall that extends around a perimeter of the recess and a shape corresponding to a shape of the recess and a thickness equal to a height of the sidewall of the recess. The insert is attached at least to the support surface of the recess. The internal insert has a recess corresponding to a shape of a raised surface of an interior surface of the helmet shell, wherein shape the raised surface corresponds to the shape of the recess in the helmet shell. The first material has a first stiffness that is less than a second stiffness of the second material and the third material has a third stiffness that is less than the first stiffness and the second stiffness.

An example of a composite helmet shell includes a front, a rear, sides, and a crown formed from a single piece of a first material, wherein at least the crown has a recess. An insert formed from a second material has a shape corresponding to a shape of the recess in the crown. An internal insert formed from a third material has a recess corresponding to a shape of an interior surface of the helmet shell.

BRIEF DESCRIPTION OF THE DRAWINGS

To further clarify various aspects of embodiments of the present disclosure, a more particular description of the certain embodiments will be made by reference to various aspects of the appended drawings. It is appreciated that these drawings depict only typical embodiments of the present disclosure and are therefore not to be considered limiting of the scope of the disclosure. Moreover, while the figures can be drawn to scale for some embodiments, the figures are not necessarily drawn to scale for all embodiments.

DETAILED DESCRIPTION

Figure 1:
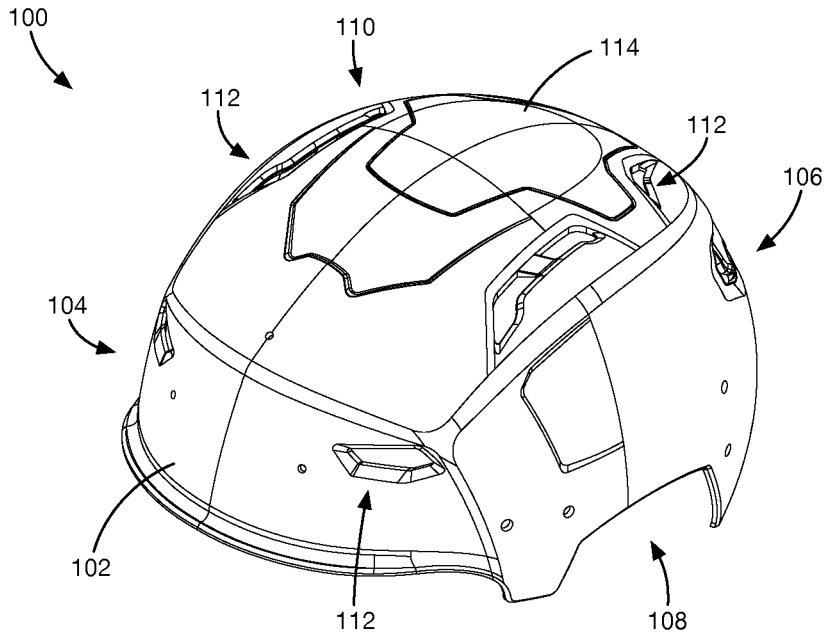
FIG. 1 shows a top-left-front perspective view of an exemplary helmet shell.
Figure 2:
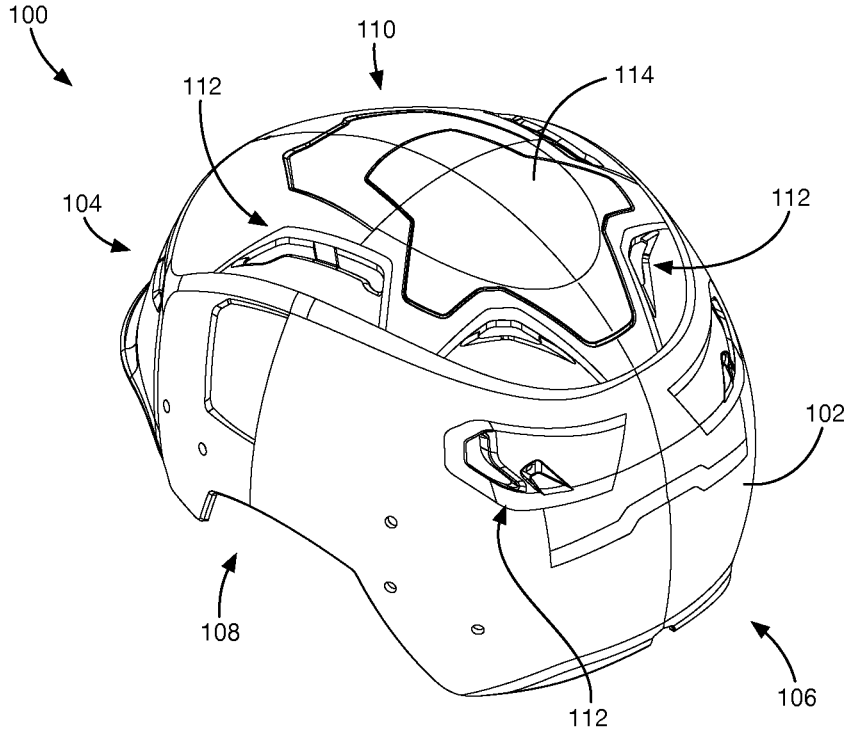
FIG. 2 shows a top-left-rear perspective view thereof.
Figure 3:
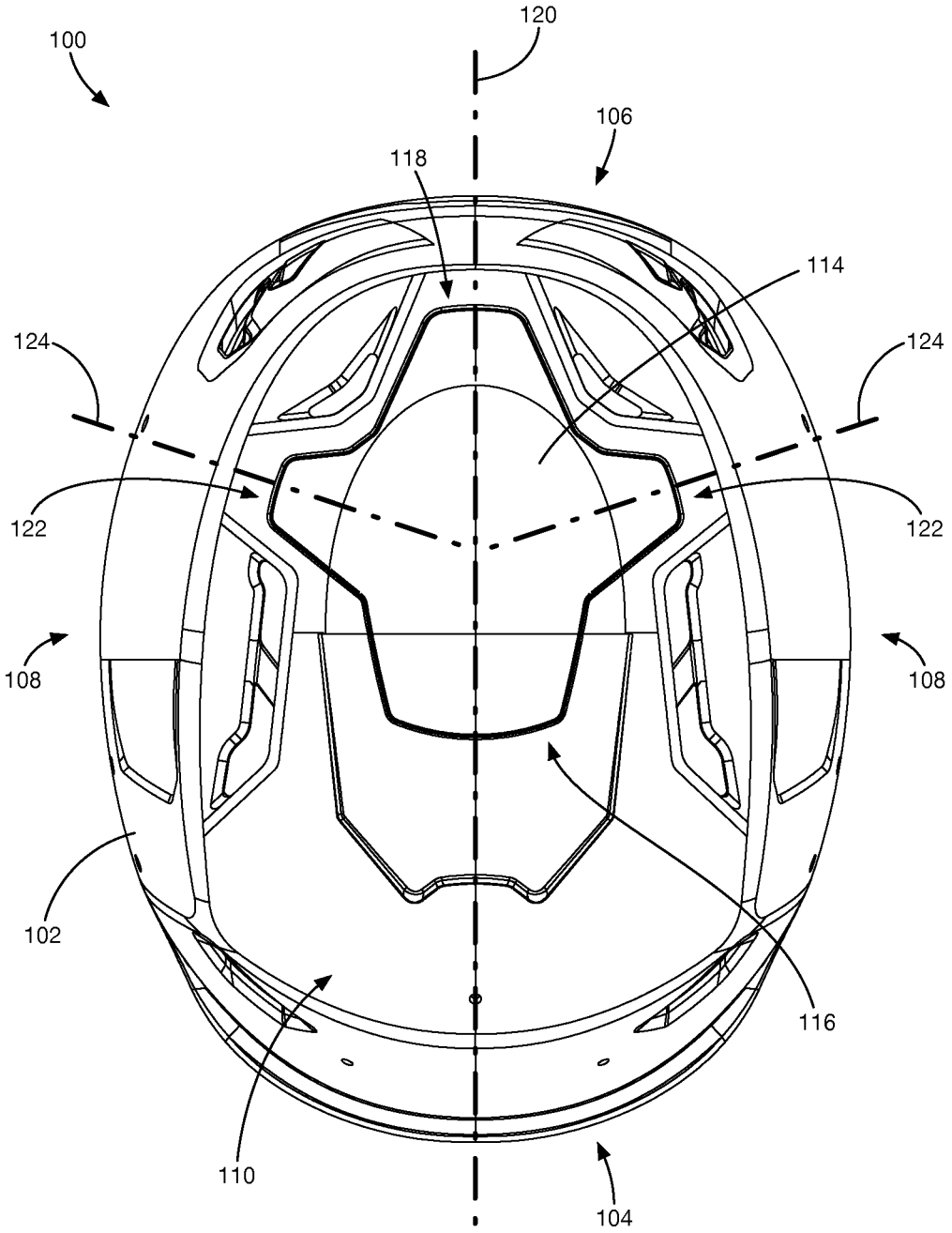
FIG. 3 shows a top view thereof.

The following description refers to the accompanying drawings, which illustrate specific embodiments of the present disclosure. Other embodiments having different structures and operation do not depart from the scope of the present disclosure.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Additionally, as used herein, the term "exemplary" is intended to mean serving as an illustration or example of something and is not intended to indicate a preference.

Numerical values or ranges stated herein are understood to encompass values at or near the stated value and/or above or below the stated range. For this application, the stated value can encompass plus or minus 5% of the value and the stated range can encompass plus or minus 5% of the extent of the range. In addition, the stated value or range can include a margin of error for the value or range typical in the art for the property being measured. The stated value or range can also encompass those values and ranges that would be considered equivalent to the stated value or range by one of ordinary skill in the art. As an example, a pressure expressed as a range of 1 to 5 psi is understood to include durations above and below the ends of the range by 5% of the extent of the 4-psi range—e.g., 0.8 psi to 5.2 psi. As another example, the size of an object expressed as a value of 4 millimeters includes values above and below 4 millimeters that are within the margin of error of a tool typically used to measure objects of that size. As yet another example, the density of a material expressed as a value of 8 pounds per cubic foot includes values above and below 8 pounds per cubic foot that would be considered equivalent by one of ordinary skill in the art.

Applicant has developed a helmet shell that includes local regions of increased stiffness to provide enhanced protection against impact in selected areas of the helmet. The helmet shell is formed from a first material and includes an insert formed from a second, more rigid material. The first material can be, for example, a polycarbonate plastic formed via injection molding and the second material can be, for example, a carbon fiber composite. Including areas of increased rigidity enables the creation of an exemplary helmet that can be used in a wide variety of applications and meet a wide variety of impact standards. That is, the exemplary helmets described herein replace multiple helmets used in a variety of applications with a single, multipurpose helmet.

Referring now to FIGS. 1-5, an exemplary helmet 100 is shown. The helmet 100 includes a shell 102 that forms a front 104, a rear 106, sides 108, and a crown or top 110 of the helmet 100. The helmet shell 102 can include various vents 112 arranged in the front 104, the rear 106, and the crown 110 of the helmet 100 for providing ventilation to the wearer's head. The helmet 100 can also include a liner (not shown) arranged between the helmet shell 102 and the wearer's head for distributing impact forces experienced by the shell 102 and for providing a comfortable fit. Various accessory mounts (not shown) can also be attached to the helmet shell 102 to provide locations to which accessories can be attached to the helmet 100.

Forming the helmet shell 102 from a more rigid material, such as a carbon fiber composite, can typically improve the impact performance of the helmet 100. However, forming an entire helmet shell 102 from, for example, a carbon fiber composite, would significantly increase manufacturing costs and difficulty. Applicant has compared the impact performance of polycarbonate and carbon fiber helmet shells and determined that the greatest difference in impact performance is found in the crown 110 and the rear 106 of the helmet 100. The improved stiffness of the front 104 and sides 108 of the helmet 100 relative to the crown 110 and rear 106 may be the result of accessory mounts attached to the front 104 (e.g., a night vision mounting shroud) and sides 108 (e.g. accessory rails) of the polycarbonate helmet shell. Thus, in helmets that include accessory mounts for use in tactical situations, additional reinforcement in the crown and/or the rear of the helmet can help to increase the overall stiffness of the helmet shell.

Exemplary helmets 100 described herein include one or more inserts 114 formed from a material that is more rigid than the material of the helmet shell 102 for increasing protection to the wearer against external impacts to the helmet 100 that may strike the helmet 100 in the area of the insert 114. The insert 114 can be formed of any suitable material that is more rigid than the material of the helmet shell 102 such as, for example, a carbon fiber composite material.

The helmet shell 102 can be formed from a wide variety of lightweight and rigid materials such as, for example, an injection molded polycarbonate plastic. The helmet shell 102 can be from 1 millimeter to 3 millimeters thick, or 2 millimeters thick. The thickness of the helmet 102 can be substantially uniform or can include areas of increased or reduced thickness. The insert 114 can be formed to a same thickness as the helmet shell 102 such as, for example, to a thickness of 1 millimeter to 3 millimeters, or 2 millimeters. Like the helmet shell 102, the insert 114 can be formed with a uniform thickness or can include areas of increased or reduced thickness. Alternatively, the insert 114 can include areas of greater thickness to provide additional rigidity in the thicker area.

The insert 114 can take on a wide variety of shapes and be positioned in a wide variety of locations of the helmet shell 102. The exemplary insert 114 shown in FIGS. 1-5 is arranged in a portion of the crown 110 that is closer to the rear 106 of the helmet 100. The insert 114 has a somewhat teardrop shape extending from a front end 116 to a rear end 118 along a centerline 120 of the helmet 100. That is, the insert 114 gradually widens after the front end 116 and then narrows towards the rear end 118. The insert 114 also includes a pair of laterally extending lobes 122 that extend toward the sides 108 of the helmet 100. The lobes 122 extend laterally along axes 124 that extend from the centerline 120 of the helmet 100 towards the sides 108 and rear 106 of the helmet 100.

Figure 4:
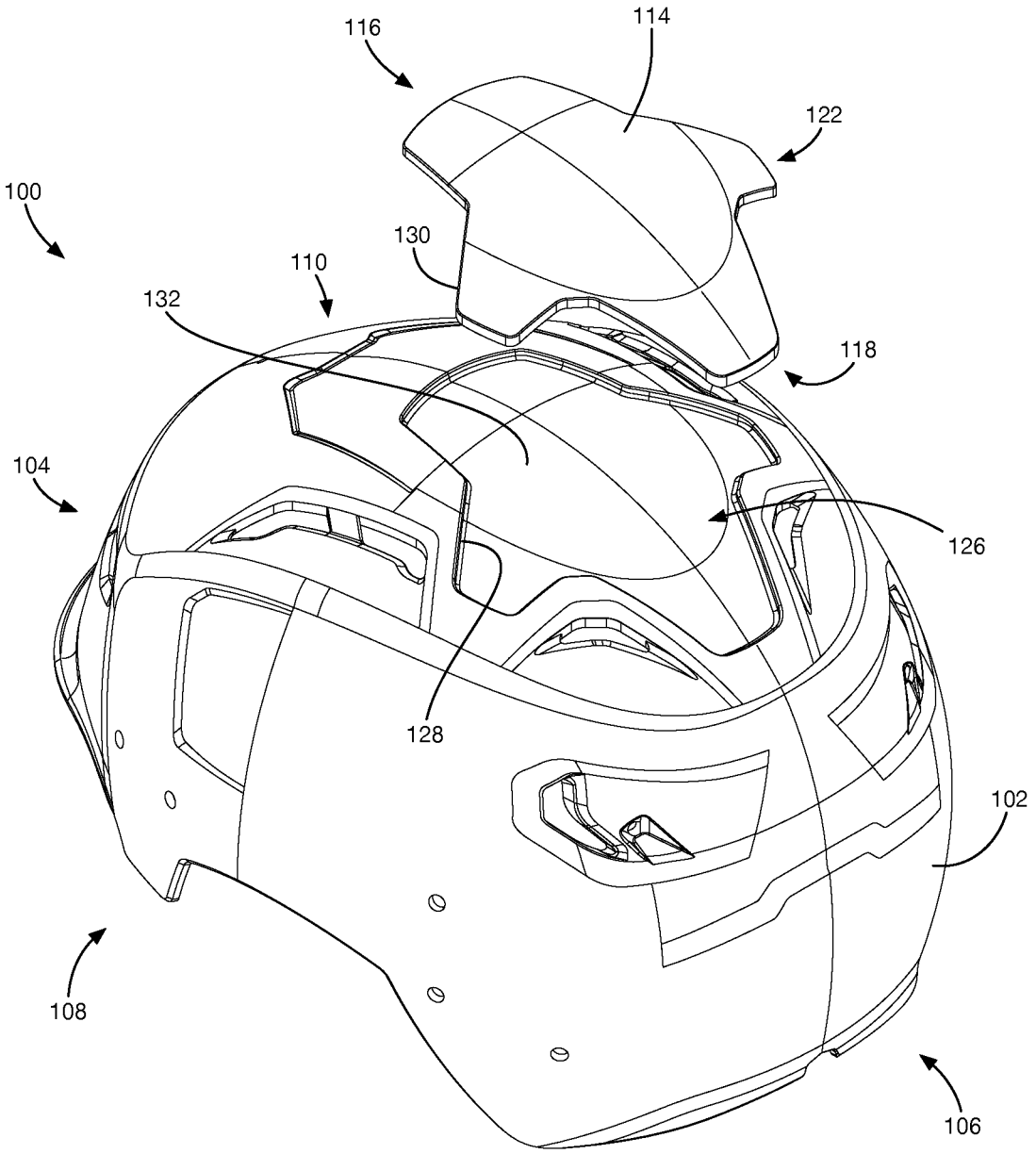
FIG. 4 shows an exploded view thereof.
Figure 5:
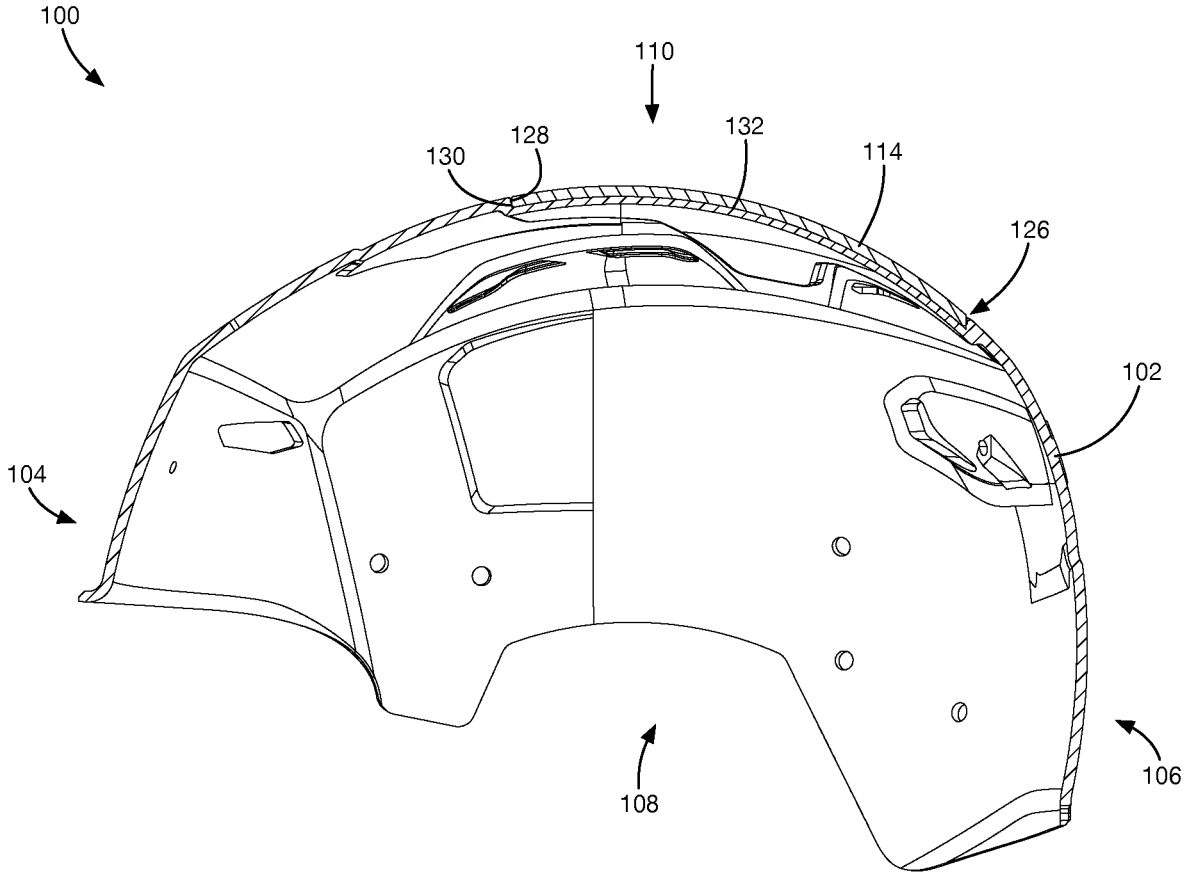
FIG. 5 shows a cross-sectional view thereof, taken along a median plane of the helmet.
Figure 6:
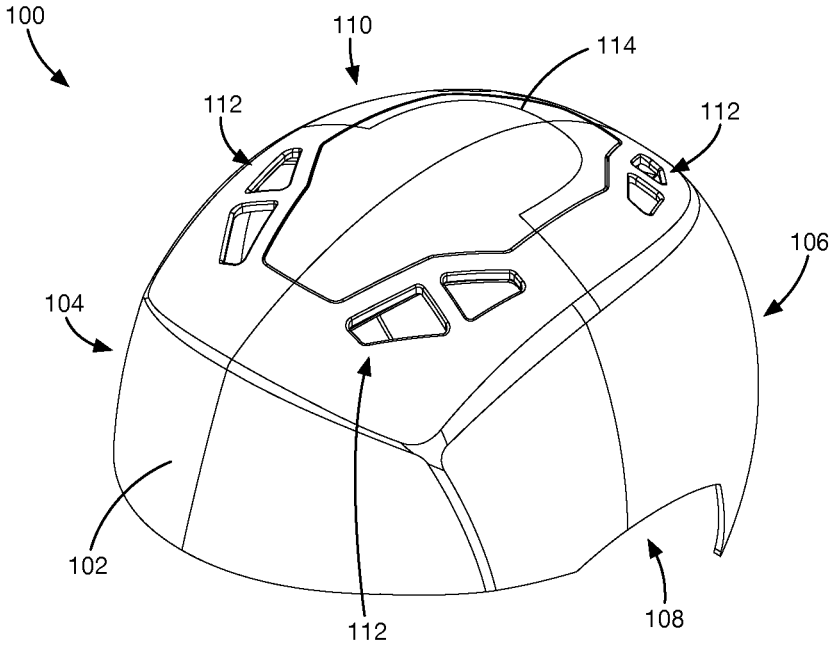
FIG. 6 shows a top-left-front perspective view of an exemplary helmet shell.
Figure 7:
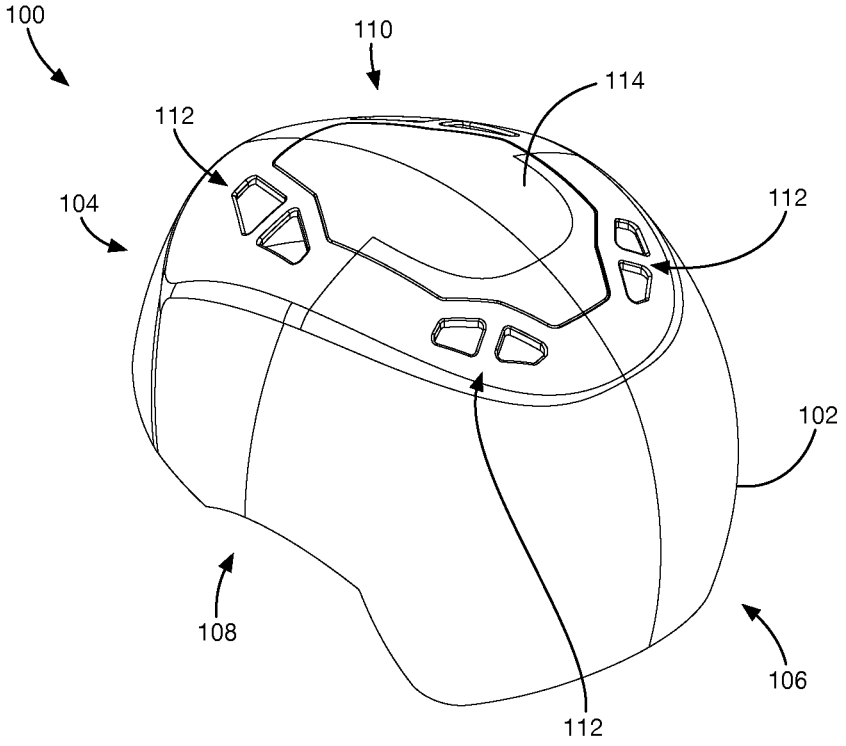
FIG. 7 shows a top-left-rear perspective view thereof.
Figure 8:
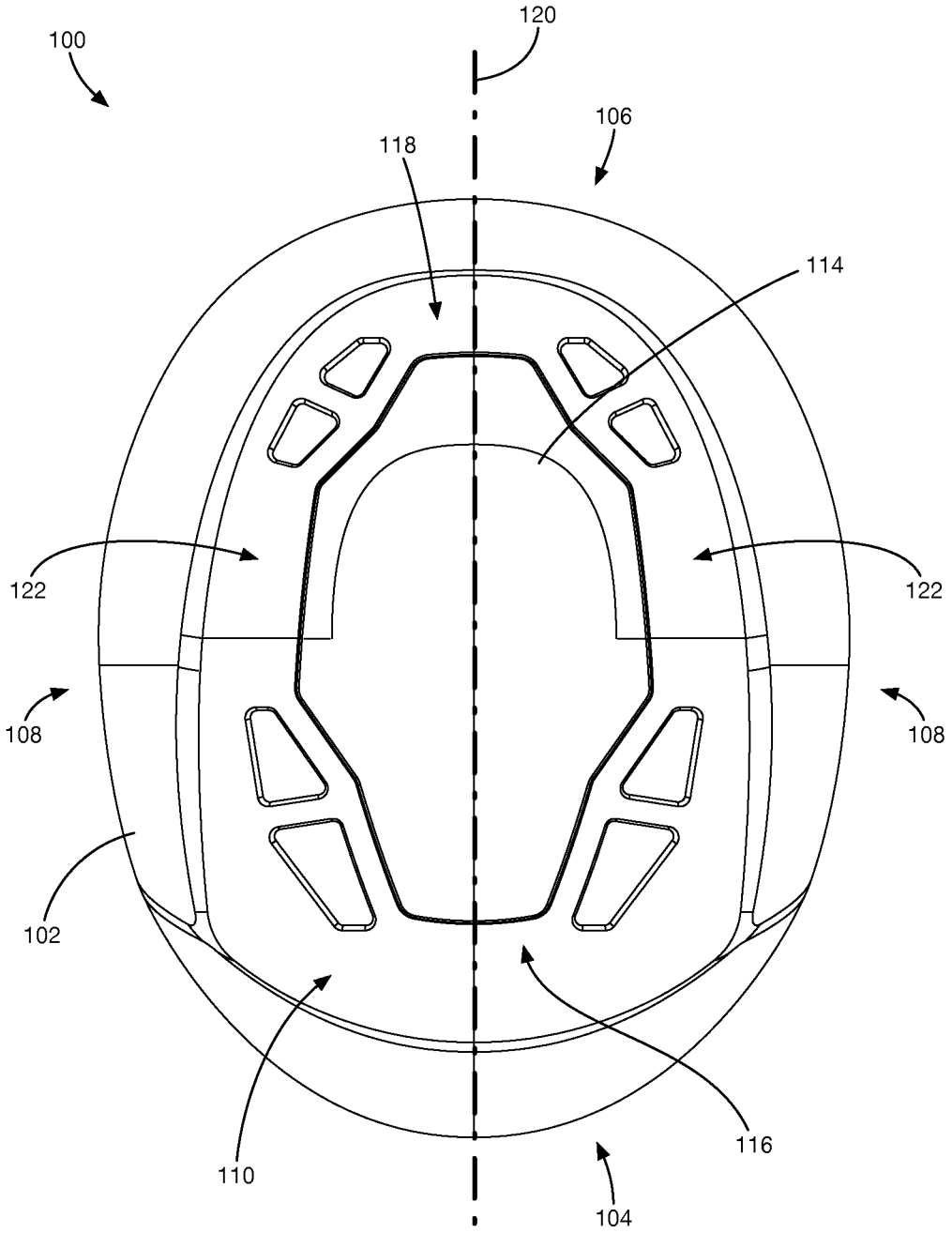
FIG. 8 shows a top view thereof.

An indentation or recess 126 formed in the crown 110 of the helmet shell 102 has a shape that corresponds to the shape of the insert 114 so that the insert 114 can be inserted 114 into the recess 126 to be secured to the helmet shell 102. That is, descriptions of the insert 114 above apply correspondingly to the shape of the recess 126. As can be seen in FIG. 4 and FIG. 5, the recess 126 extends into the helmet shell 102 from an exterior surface so that the insert 114 is visible from outside the helmet 100. The recess 126 in another exemplary helmet 100 can be extend from an interior surface of the helmet shell 102 to hide the insert 114 from view.

When the insert 114 is installed in the recess 126 of the helmet shell 102, a sidewall 128 of the recess 126 covers at least a portion of an edge 130 of the insert 114. The sidewall 128 extends around a perimeter of the recess 126. Covering the edge 130 of the insert 114 can protect and conceal the edge 130 of the insert 114. In this way, the sidewall 128 of the recess 126 prohibits damage to the insert 114. During an impact event, a foreign object coming into contact with the helmet shell 102 is also blocked by the sidewall 128 from catching the edge 130 of the insert 114 to impart force to the insert 114 in a direction that could work against the attachment of the insert 114 to the helmet shell 102.

The recess 126 can have a depth that is equal to the thickness of the insert 114 to provide a smooth exterior surface of the helmet 100 between the helmet shell 102 and the insert 114. Alternatively, the insert 114 can be recessed into the surface of the helmet 100 by providing a recess 126 that is deeper than the thickness of the insert 114. Or the insert 114 can protrude from the surface of the helmet 100 by providing a recess 126 that is shallower than the thickness of the insert 114.

The recess 126 extends from the exterior or interior surface of the helmet shell 102 to a support surface 132 that supports the insert 114 at a desired depth relative to the helmet shell 102. That is, the depth of the recess can be measured between an outer surface of the helmet shell 102 and a support surface 132 of the recess 126. While the support surface 132 is shown as a solid surface—i.e., the support surface 132 is not shown with any holes or openings formed therein—the support surface 132 can be formed by a ledge or shelf (e.g., FIGS. 11-12) that extends around a perimeter of the recess 126 so that the insert 114 is visible from the interior and the exterior of the helmet 100.

The insert 114 can be attached to the helmet shell 102 in a wide variety of ways. For example, the insert 114 can be secured in the recess 126 using an adhesive or glue, adhesive tape, heat staking, mechanical fasteners, or a combination thereof. An exemplary helmet 100 includes a pressure sensitive adhesive between the support surface 132 and the insert 114 that activates to adhere the insert 114 to the helmet shell 102 when the insert 114 is inserted into the recess 126 and is then subjected to a compression force that presses the insert 114 against the support surface 132. In another exemplary helmet 100, the insert 114 is attached to the helmet shell 102 via overmolding—i.e., the insert 114 is positioned inside of a mold for the helmet shell 102 so that the helmet shell 102 is injection molded around the insert 114. Depending on the placement of the insert 114 in the mold, the insert 114 can be visible on the exterior or interior of the helmet 100 or can be entirely encapsulated by the helmet shell 102 so that the insert 114 is not visible.

While the insert 114 is formed from a different material than the helmet shell 102, the insert 114 can be coated—e.g., wrapped, sprayed, or otherwise covered—with a material that is similar to or the same as a coating applied to the helmet shell 102. For example, the helmet shell 102 and the insert 114 can be covered with one or more layers of paint, varnish, a plastic coating, a vinyl or similar wrap, or the like. Inserts formed from carbon fiber composites can also be left in a "raw" state so that the fiber weave of the composite material is visible through the resin of the composite.

Referring now to FIGS. 6-12, an example of the helmet 100 is shown with the shell 102, the vents 112, and the insert 114 having a different shape and/or location than the shell 102, the vents 112, and the insert 114 of the example of the helmet 100 shown in FIGS. 1-5. The materials and other properties of the shell 102 and the insert 114 shown in FIGS. 6-12 are the same as described above with respect to FIGS. 1-5.

As was noted above, the insert 114 can take on a wide variety of shapes and be positioned in a wide variety of locations of the helmet shell 102. The example insert 114 shown in FIGS. 6-12 is arranged in a portion of the crown 110 that is arranged in a location that is somewhat equally spaced between the front 104 and the rear 106 of the helmet 100. The insert 114 of FIGS. 6-12 has a shape that is similar to the insert 114 shown in FIGS. 1-5, though the insert 114 of FIGS. 6-12 is longer from the front end 116 to the rear end 118 and has laterally extending lobes 122 that are less pronounced than the laterally extending lobes 122 of the insert 114 of FIGS. 1-5.

Referring now to FIGS. 9-12, the helmet shell 102 is shown with an optional internal insert 134 that is attached to an interior or a first internal surface 136 of the helmet shell 102. The internal insert 134 can be formed from a wide variety of materials, such as, for example, plastics, rubbers, elastomeric materials, composite materials, and the like. The internal insert 134 can provide additional strength and stiffness to the crown 110 of the helmet 100 and can assist in the dissipation of impact energy imparted to the helmet shell 102 from foreign objects. An example of the internal insert 134 is formed from a foam padding material such as any of the materials discussed below with regards to a helmet liner. An example of the internal insert 134 is formed from expanded polypropylene foam.

The internal insert 134 can be attached to the helmet shell 102 in a wide variety of ways. For example, the internal insert 134 can be secured in the recess 126 using an adhesive or glue, adhesive tape, heat staking, mechanical fasteners, or a combination thereof. An exemplary helmet 100 includes a pressure sensitive adhesive between the internal surface 136 and the internal insert 134 that activates to adhere the internal insert 134 to the helmet shell 102 when the internal insert 134 is placed against the first internal surface 136 and is then subjected to a compression force that presses the internal insert 134 against the first internal surface 136.

Figure 9:
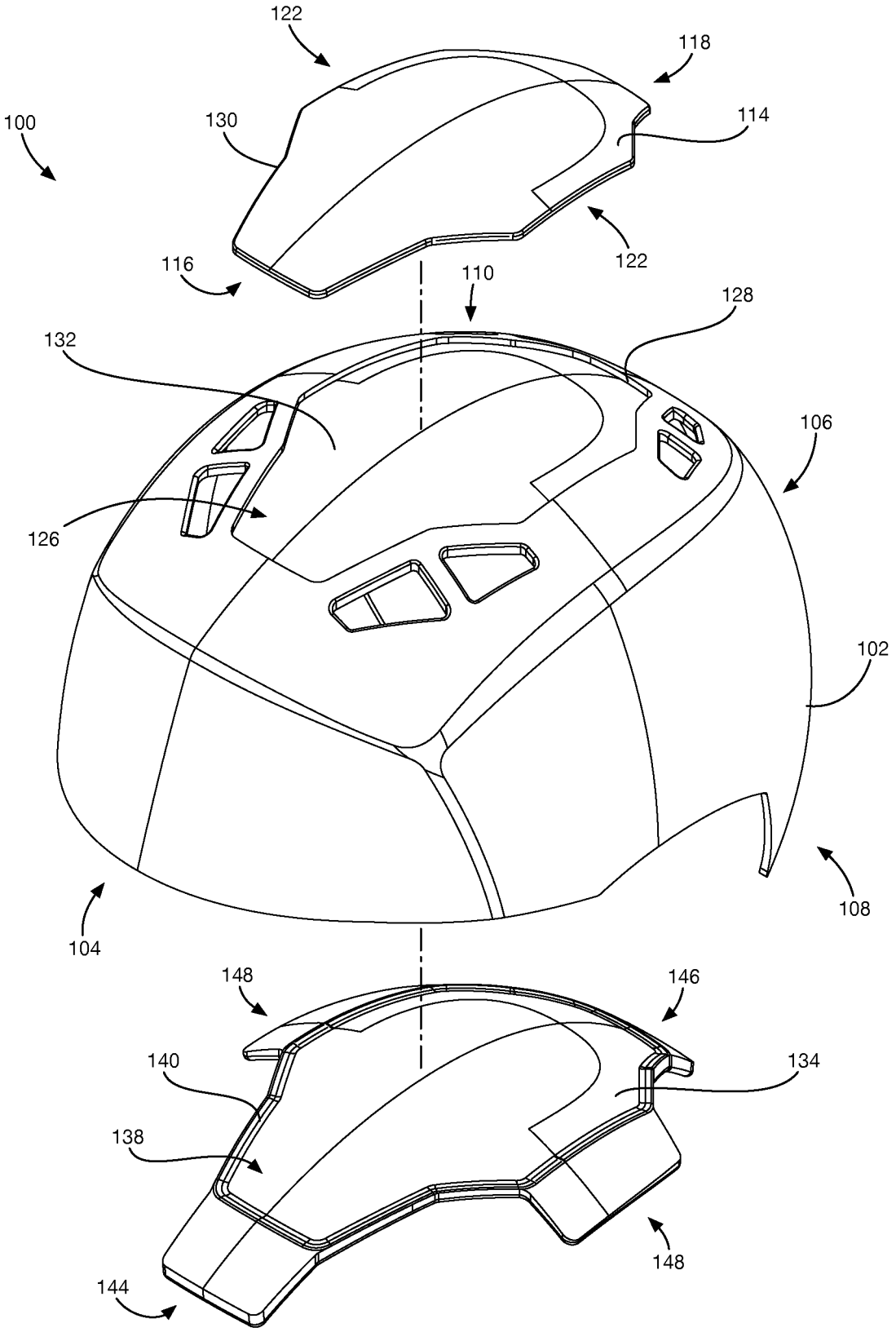
FIG. 9 shows an exploded view thereof.
Figure 10:
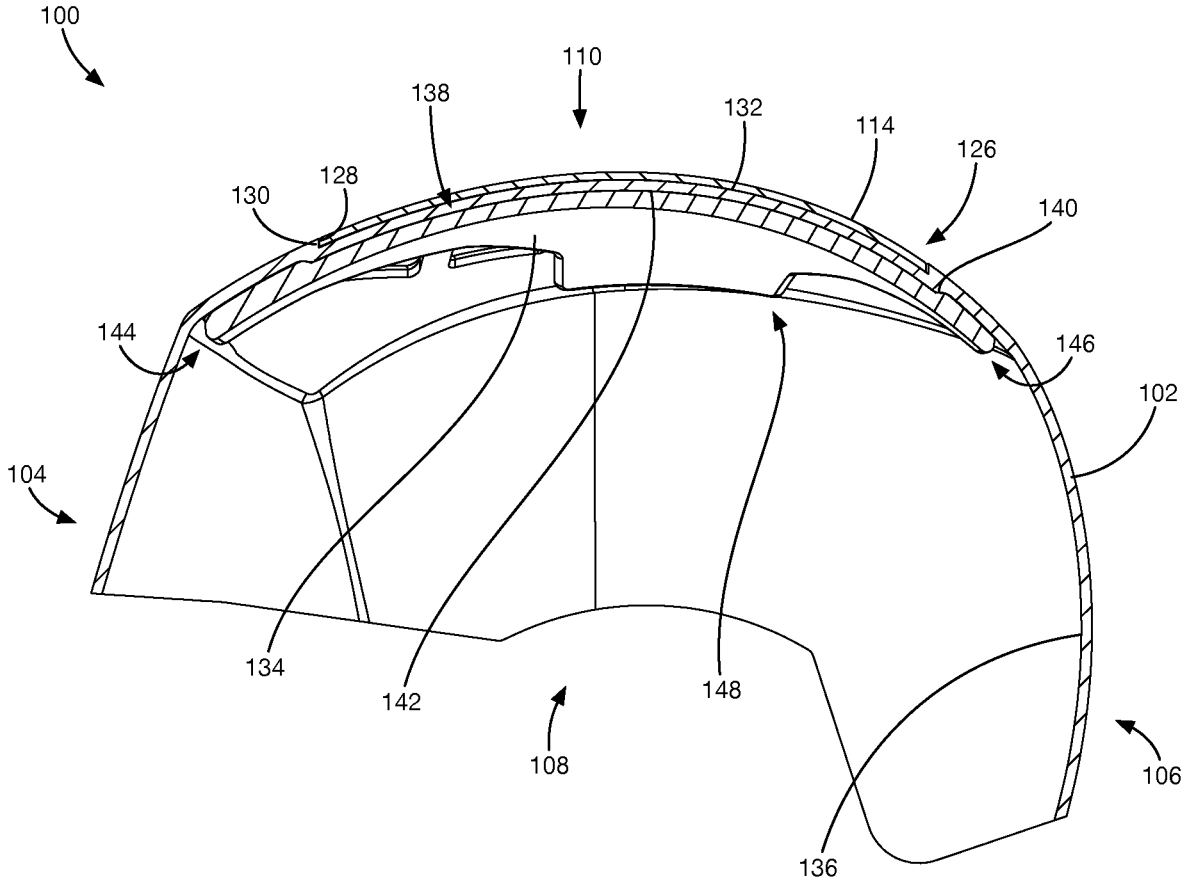
FIG. 10 shows a cross-sectional view thereof, taken along a median plane of the helmet.

As can be seen in FIG. 9, the optional internal insert 134 includes a depression or recess 138 having a sloped perimeter 140 that corresponds to a second internal surface 142 of the helmet shell 102 in the area of the recess 126. The second internal surface 142 is spaced apart from the first internal surface 136 to form a raised area or plateau relative to the remainer of the helmet shell 102. In an example of a helmet shell 102, the distance between the first internal surface 136 and the second internal surface 142 is equal to the depth of the recess 126. The depression or recess 138 and the sloped perimeter 140 facilitate the alignment of the internal insert 134 with the second internal surface 142 of the helmet shell 102. The internal insert 134 can also include a plurality of extensions or tabs extending outward from the depression or recess 138: a front extension 144, a rear extension 146, and a pair of side extensions 148. The extensions 142, 144, and 146 provide additional surface area for attaching the internal insert 134 to the helmet shell 102 and can also further facilitate alignment between the depression or recess 138 and the second internal surface 142.

Figure 11:
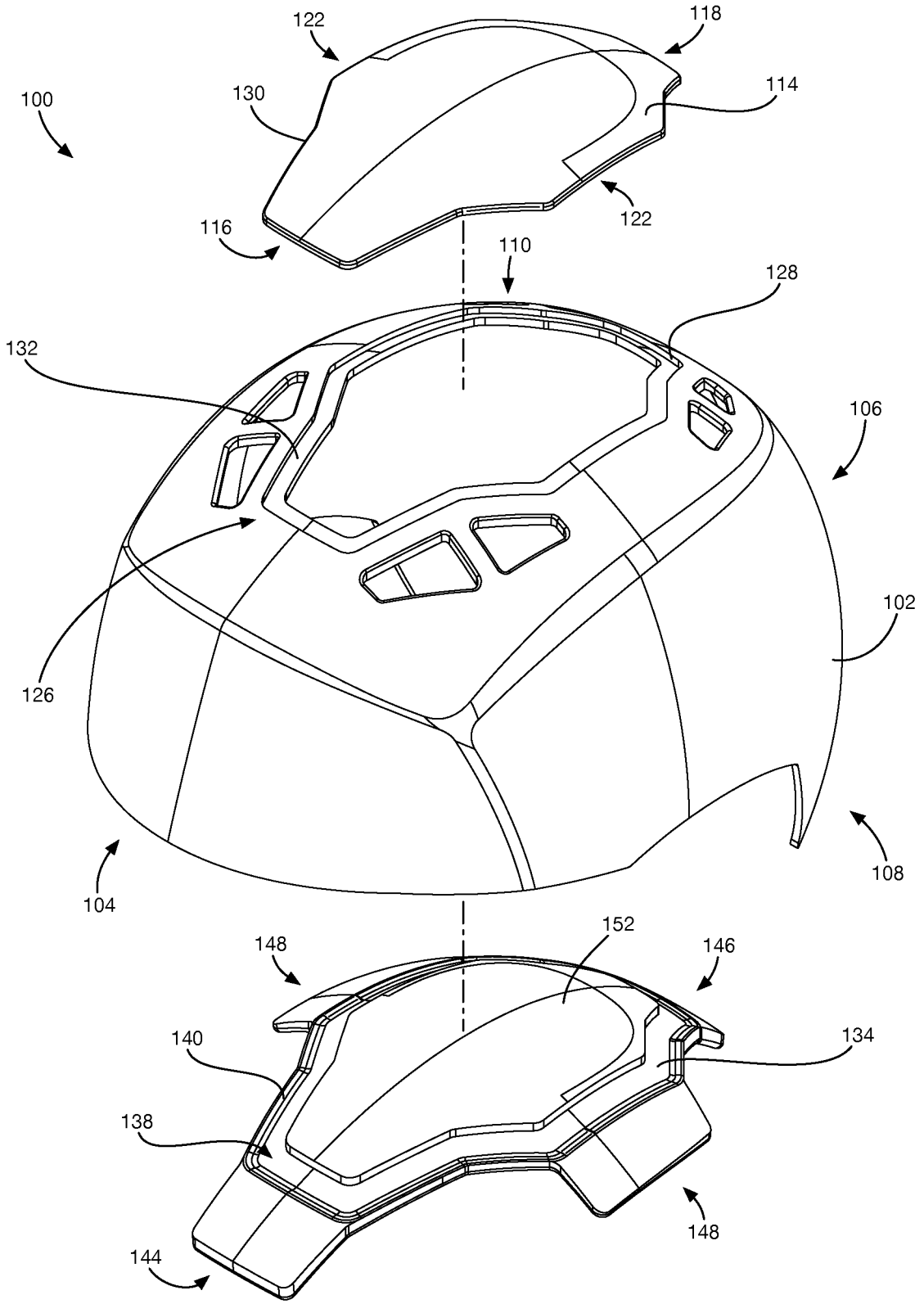
FIG. 11 shows an exploded view thereof.
Figure 12:
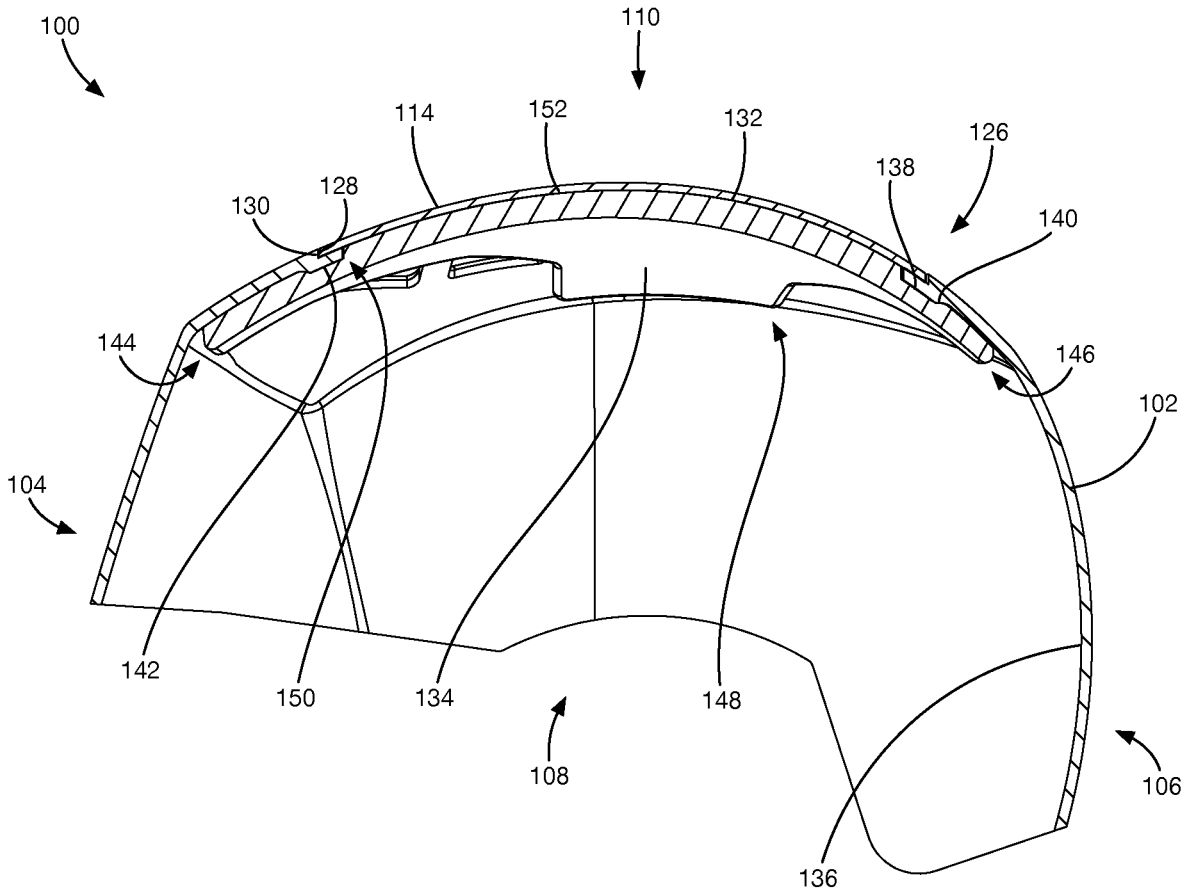
FIG. 12 shows a cross-sectional view thereof, taken along a median plane of the helmet.
Figure 13:
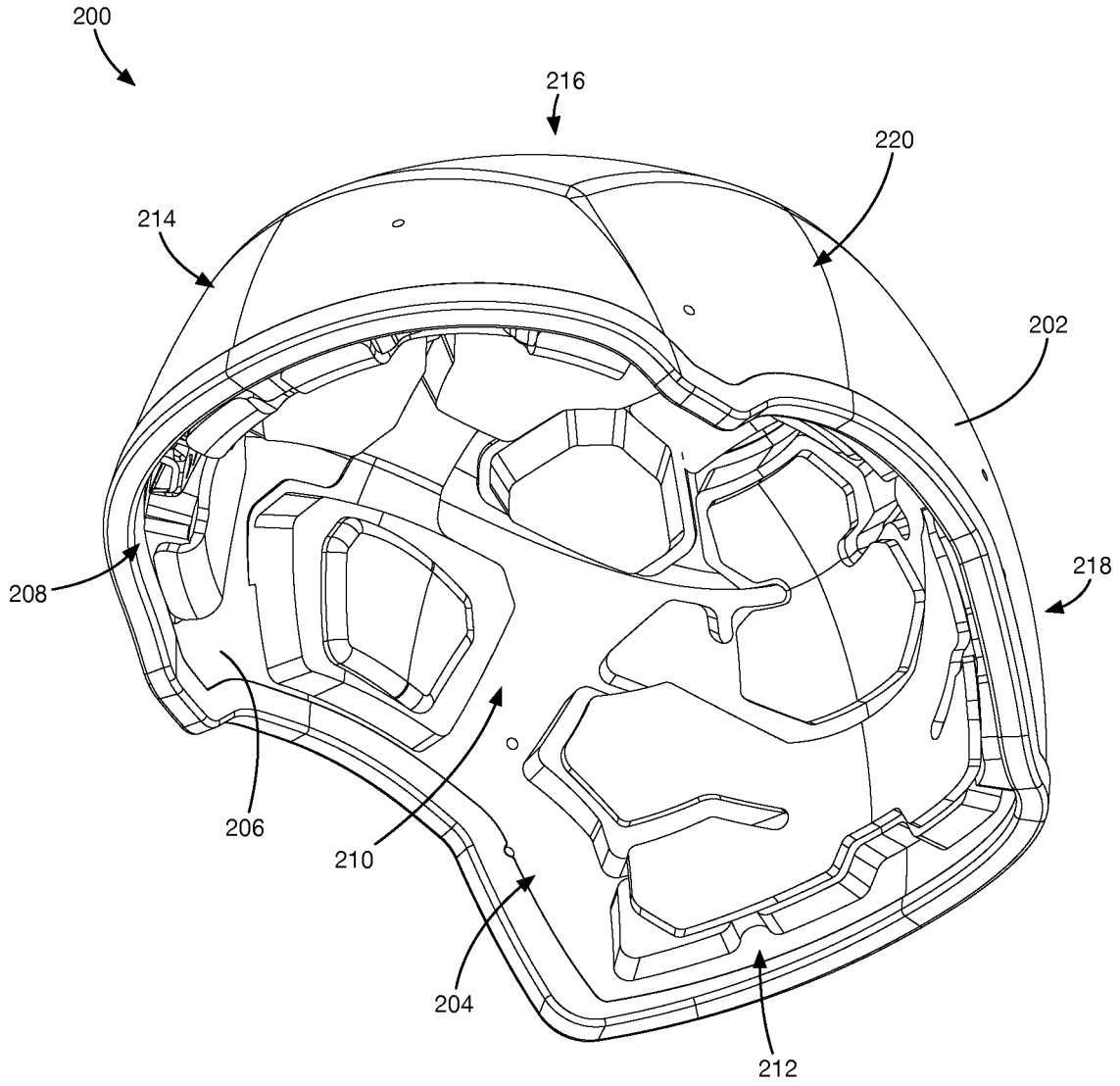
FIG. 13 shows a perspective view of an exemplary helmet and helmet liner.

Referring now to FIGS. 11-12, the indentation or recess 126 formed in the crown 110 of the helmet shell 102 extends from the exterior or interior surface of the helmet shell 102 to a support surface 132 formed as a ledge that extends around the perimeter of the recess 126 to surround an opening 150. To fill the opening and to support the insert 114, the internal insert 134 further includes a raised area or protrusion 152 that corresponds to the shape of the opening 150 and extends from the depression or recess 138 to the underside of the insert 114 to support the same. An example internal insert 134 is formed from a material that is less dense than the helmet shell 102—e.g., the expanded polypropylene foam noted above—so that the opening 150 formed in the helmet shell 102 reduces the weight of the helmet 100 even though the opening 150 is filled by the raised area or protrusion 152 of the internal insert 134.

As was noted above, helmets, such as sporting helmets, generally include a shell and a liner. The helmet shell generally provides protection from protruding objects and is often configured to spread the impact load across the footprint of the helmet. Ballistic helmets used by military and law enforcement are commonly constructed with aramid or ultra high molecular weight polyethylene (UHMWPE) fabrics within a resin matrix. The shells of these helmets, such as the Advanced Combat Helmet (ACH) and Enhanced Combat Helmet (ECH), are relatively rigid and non-flexible, typically range in thickness from 0.2 inches to 0.5 inches, and typically have areal densities ranging from 1.0 to 2.5 pounds per square foot (psf).

Helmet liners are generally made from a softer and lower density material than the helmet shell to provide a comfortable fit for the wearer. The helmet liner is configured so that, upon impact, the helmet liner at least partially absorbs and disperses the impact energy. When the helmet shell receives an impact, the helmet liner can compress unevenly due differences in the geometry of the helmet shell and wearer's head, and as a result of force applied to the helmet. Put another way, the helmet and the wearer's head experience different accelerative forces depending on the location of an impact.

Applicant has developed a helmet liner that provides different impact response depending on the location of impact. The helmet liner includes using a combination of foams within a single pad assembly or segment of the helmet liner to improve impact performance and enhanced comfort. For example, an exemplary helmet liner described herein is capable of protecting the wearer from impacts having a magnitude of up to 14 feet per second. That is, the acceleration experienced by the wearer's head is below an acceleration threshold (measured in multiples of gravitational acceleration, or "G's") when the helmet is subjected to an impact of up to 14 feet per second. Exemplary helmet liners described herein also improve air flow around the wearer's head and can accommodate attachment straps for an air purifying respirator ("APR" or "gas mask").

Referring now to FIGS. 13-17, perspective and cutaway views of an exemplary helmet 200 are shown. The helmet 200 includes a shell 202 and a liner 204 disposed within and attached to the shell 202. The shell 202 can be formed from any suitable rigid material, such as, for example, carbon fiber, plastic, and other composite materials (e.g., aramid or UHMWPE fabrics in a resin matrix). The liner 204 is removably attached to an inner surface 206 the shell 202 via, for example, hook and loop material, an adhesive, fasteners, or the like. Exemplary helmets 200 described herein can include, but are not limited to, military helmets, sporting helmets, such as football, lacrosse, hockey, multi-sport, cycling, softball, or baseball helmets, or safety helmets, such as industrial or construction helmets.

The liner 204, shown separated from the shell 202 in FIGS. 18-34, is divided into a plurality of segments or assemblies, each including one or more pads. The liner 204 of the exemplary helmet 200 is formed from a front pad assembly or segment 208, a central pad assembly or segment 210, and a rear pad assembly or segment 212. Each of the pad assemblies 208, 210, 212 is shaped to cover a portion of the inner surface 206 of the helmet shell 202 so that all of the pad assemblies 208, 210, 212 together cover a front 214, a crown 216, a rear 218, and sides 220 of the helmet 200. Air channels or gaps 222 can be formed between and within the pad assemblies 208, 210, 212 to allow air to flow around the wearer's head for ventilation.

When a foreign object collides with the helmet shell 202, the pads of the liner 204 can deform or crush to consume a portion of the impact energy so that it does not reach the wearer's head. More specifically, the pads provide a resistance to the force applied to them to reduce the kinetic energy of the head by bringing the wearer's head velocity from an initial impact velocity to a stop—i.e., zero velocity. The pads of the liner 204 can also dissipate the impact force over a larger surface area than the actual area of impact so that the force per unit area is decreased for the wearer's head compared to that of the initial impact surface (e.g. and outer surface of the helmet shell 202). Applicant has developed a wide variety of foam materials for use in the pads of helmet liners and found that some foam materials provide enhanced impact protection but at the cost of a greater density. Using such materials throughout the liner 204 would increase the overall weight of the helmet 200 and, consequently, the strain on the neck of the wearer. Exemplary helmet liners 204 described herein incorporate impact pads formed from different foam materials having different densities and impact resistance to provide enhanced protection while maintaining an acceptable level of comfort to the wearer.

The impact force can be unevenly distributed to the wearer's head through the liner 204, depending on the magnitude and velocity of the trajectory of the foreign object. Thus, pads having a greater impact resistance can be arranged in areas of the helmet 200 that experience more of the impact force to avoid using heavier pads throughout the entirety of the liner 204. For example, where the helmet 200 experiences higher impact forces, the liner 204 can include thicker and/or more dense pads. In areas where the helmet 200 experiences lower impact forces, the liner 204 can include thinner and/or less dense pads. As a result, the impact performance of the helmet 200 can be enhanced without compromising the wearer's comfort.

The pads of the liner 204 can be formed from a wide variety of materials that deform when subjected to an impact force to dissipate energy from the impact, such as, for example, a flexible and resilient polymeric protective foam. Polymeric protective foams (e.g. protective or impact resistant foam layers) are widely used for impact force attenuation in a variety of safety-related applications. Such foams can be rigid or semi-rigid and, due to their rigidity, do not instantaneously yield upon impact. That is, rigid and semi-rigid foam layers typically have sufficient rigidity to transmit at least a portion of the impact energy from the point source (impact site) to lateral or adjacent regions of the foam layer before the energy is transmitted to the underlying body part. The result is to spread the impact force over a larger area and thereby reduce the force per unit area experienced by the underlying body part as described above.

Rigid and semi-rigid foams can be compressed or deflected at lower impact velocities to absorb some degree of the impact energy and can be made rigid enough to provide adequate impact energy absorption for blunt impacts and for high-speed impacts, such as ballistic impacts in a ballistic helmet. Repeated impacts present a challenge to the ability of a rigid or semi-rigid foam liner for use in a helmet to recover after compression. However, Applicant has found that increasing the density of the foam can provide improved response to ballistic, high-speed impacts and also improved response to repeated impacts, such as repeated blunt impacts as compared to foams having a similar rigidity and lower density.

The pads of the liner 204 can be formed from, for example, a flexible and resilient polyurethane foam having an average density between 3.0 pounds per cubit foot and and 18.0 pounds per cubit foot and an average thickness between about 0.325 and 1.0 inch. For example, one impact pad comprises a polyurethane foam having an average density of about 4.0 lbs/ft$^3$. One example of such a polyurethane foam is Zorbium™ foam made by the applicant. Another impact pad comprises a polyurethane foam having an average density of about 14.0 pounds per cubic foot. However, the pads may made from a variety of other types of foam or other materials, such as, for example, expanded polypropylene, expanded polystyrene, vinyl nitrile, ethylene-vinyl acetate (EVA), open or closed cell cross linked foams, and molded polymer structures such as thermoplastic urethane (TPU).

Referring now to FIGS. 22-26, various views of the front pad assembly 208 are shown. The front pad assembly 208 includes a plurality of impact pads 224 attached to a substrate 226. An attachment surface 228 of the substrate 226 includes one half of a hook-and-loop material (i.e., the hook or the loop side) for attaching the front pad assembly 208 to the inner surface 206 of the helmet shell 202. The impact pads 224 of the front pad assembly 208 include a front impact pad 230 flanked by two temple impact pads 232. The front impact pad 230 is configured to protect the forehead of the wearer and the temple impact pads 232 are configured to protect the temples of the wearer. Arranging the impact pads 224 on a shared substrate 226 enables the entire front pad assembly 208 to be installed into the helmet shell 202 in one operation while also maintaining a proper spacing and orientation of the impact pads 224.

The temple impact pads 232 are spaced apart from the front impact pad 230 to form a pair of air channels 222, each of which includes an insert 234. The air channels 222 formed between the front impact pad 230 and the temple impact pads 232 extend to openings 236 at the front of the helmet shell 202. The openings 236 permit external air to enter the air channels 222 and permit air from inside the helmet shell 202 to escape to the outside, thereby facilitating ventilation and cooling of the wearer's head during use of the helmet 200. The ventilation and cooling of a wearer's head via air channels is described in greater detail in U.S. Pat. No. 9,516,910, which is incorporated herein in its entirety.

Figure 26:
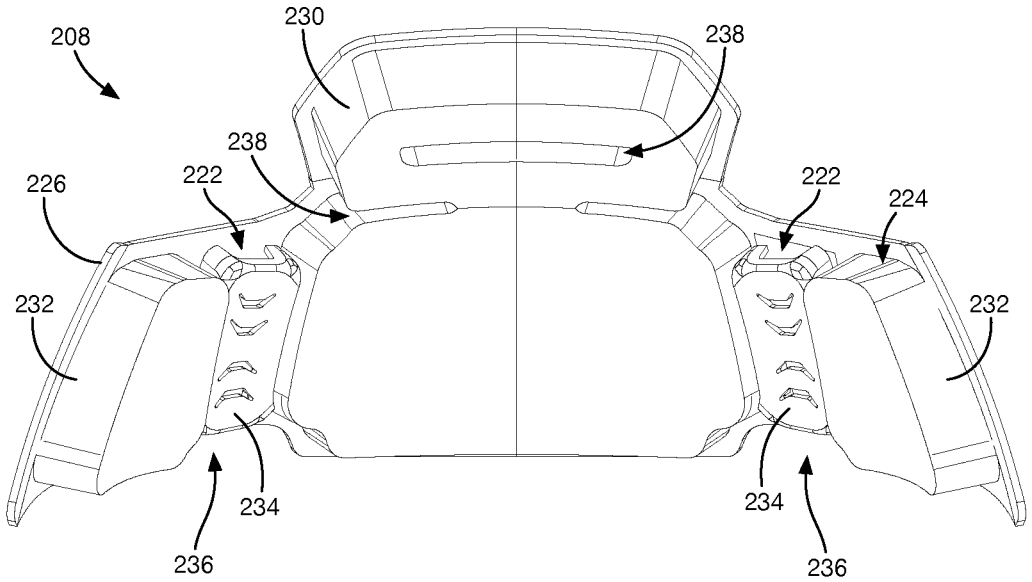
FIG. 26 shows a rear view thereof, without a comfort pad.

Exemplary inserts 234 are described in greater detail below with respect to FIGS. 35-41. As is shown in FIG. 26, the inserts 234 are arranged in the air channels 222 between the front impact pad 230 and the temple impact pads 232 to keep the air channels 222 and openings 236 from being obstructed by the impact pads 230, 232 during use of the helmet 200. The inserts 234 can also be configured to be removed from the front pad assembly 208 to provide clearance for straps and buckles of an APR or other face mask or accessory that is being worn by the wearer of the helmet 200. Providing clearance to the straps and buckles of an APR or other accessory worn between the helmet 200 and the head of the wearer improves comfort of the helmet 200 by reducing or eliminating pressure points felt by the wearer's head. The inserts 234 could also be replaced with or be formed integrally clips or mounting locations for straps or attachment members of an APR or other face mask or accessory.

The front impact pad 230 and the temple impact pads 232 can be configured to resist different impact forces. For example, the front impact pad 230 can be more stiff and/or thicker than the temple impact pads 232. The front impact pad 230 can also be formed from a more dense material than the temple impact pads 232. For example, the front impact pad 230 can be formed from a polyurethane foam having a density of about 14 pounds per cubic foot and the temple impact pads 232 can be formed from a polyurethane foam having a density of about 4 pounds per cubic foot. Forming the temple impact pads 232 from a less dense, thinner, and/or less stiff material reduces the overall weight of the liner 204 while still allowing for resistance of impacts up to 14 feet per second via the front impact pad 230. As can be seen in FIG. 26, the front impact pad 230 can include optional cutouts 238. During compression, the foam of the front impact pad 230 can deform into the cutouts 238, thereby softening the front impact pad 230 in the area of the cutouts 238.

The front pad assembly 208 also includes a front comfort pad 240 that covers at least a portion of each of the front impact pad 230 and the temple pads 232. In the illustrated embodiment, the front comfort pad 240 extends across the air channel 222 formed between the temple pads 232 and the front impact pad 230 and is prohibited from collapsing into the air channels 222 by the inserts 234. The front comfort pad 240 is formed from a softer material than the front impact pad 230 and the temple impact pads 232 to provide improved comfort for the wearer. The front comfort pad 240 can be removably attached to the impact pads 224 with a hook-and-loop fastener so that the front comfort pad 240 can be removed for cleaning or replacement. As can be seen in FIGS. 22-25, the front comfort pad 240 can wrap around bottom edges 242 of the front impact pad 230 and the temple impact pads 232 to provide a soft edge of the front pad assembly 208 in the area of the wearer's brow.

Figure 27:
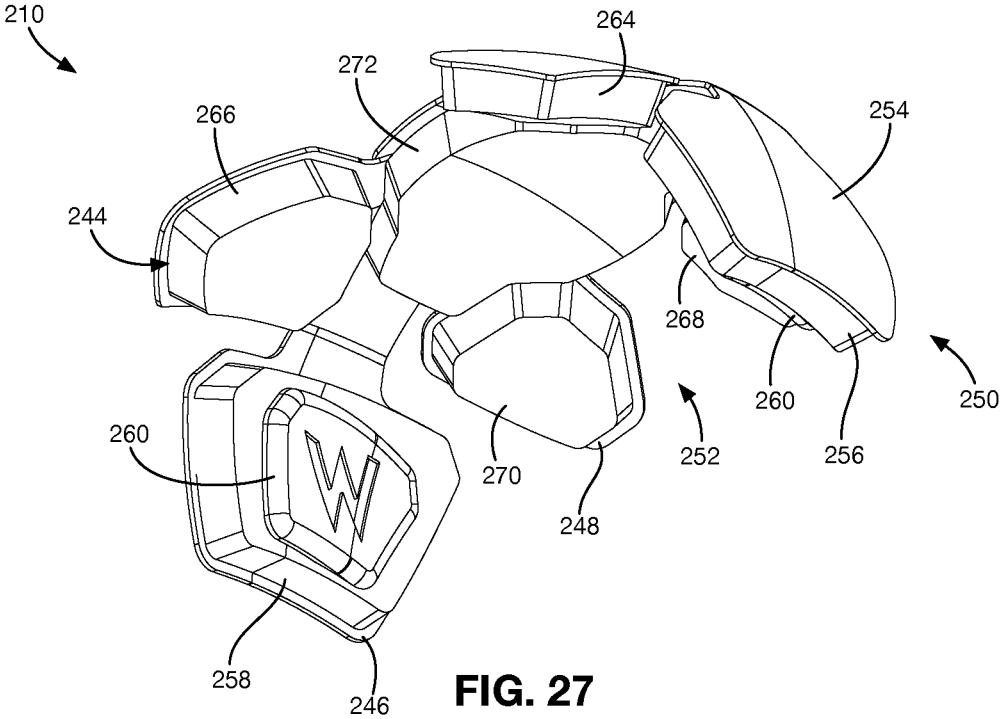
FIG. 27 shows a bottom-front perspective view of a central pad assembly.
Figure 28:
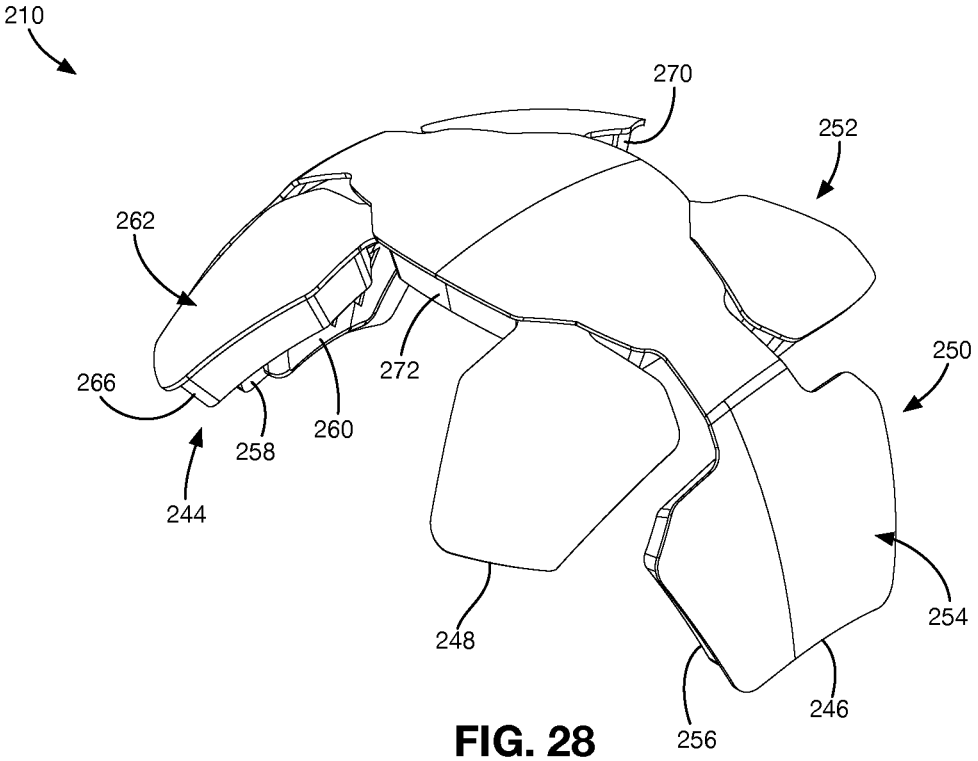
FIG. 28 shows a top-front perspective view thereof.
Figure 29:
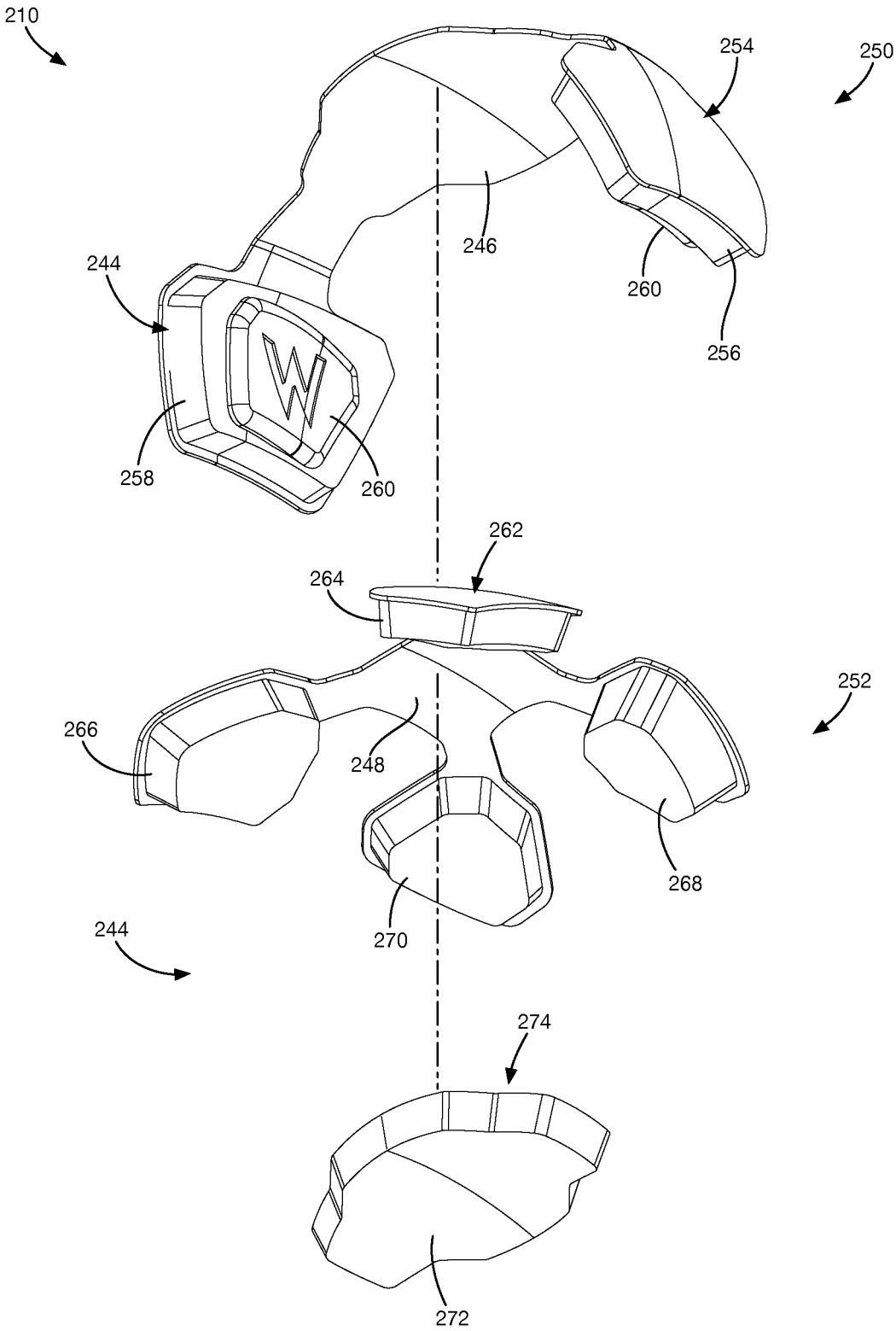
FIG. 29 shows an exploded view thereof.
Figure 30:
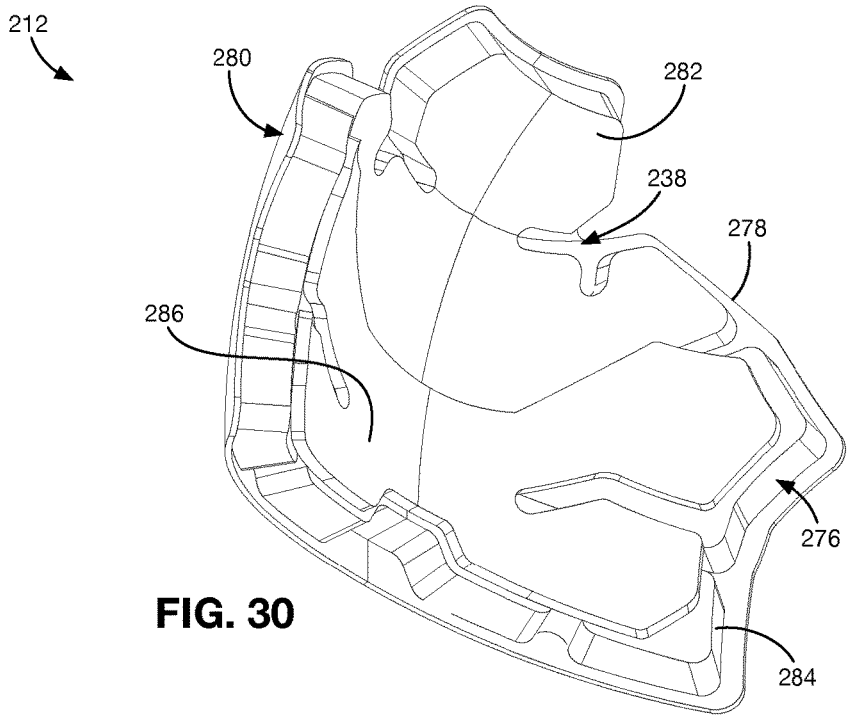
FIG. 30 shows a bottom-front perspective view of a rear pad assembly.
Figure 31:
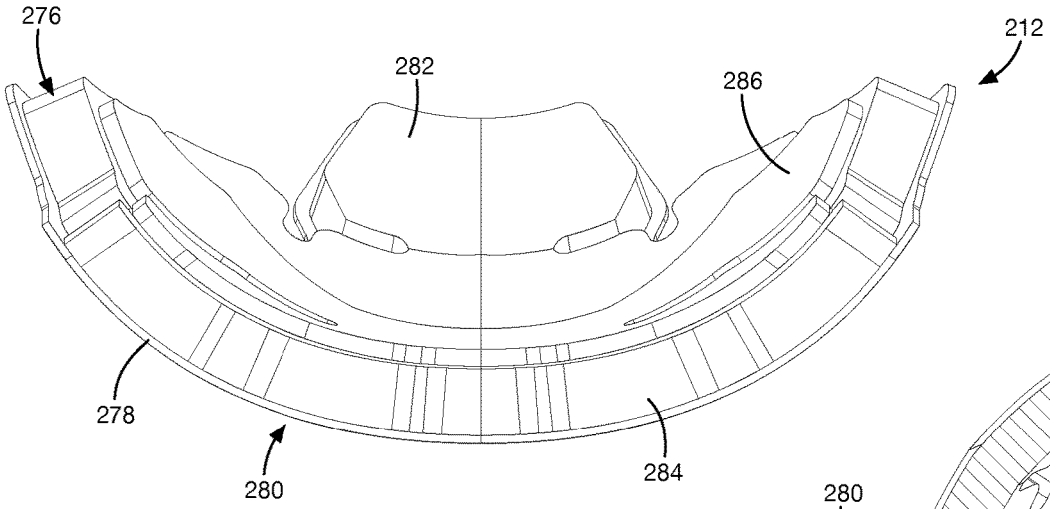
FIG. 31 shows a bottom view thereof.
Figure 32:
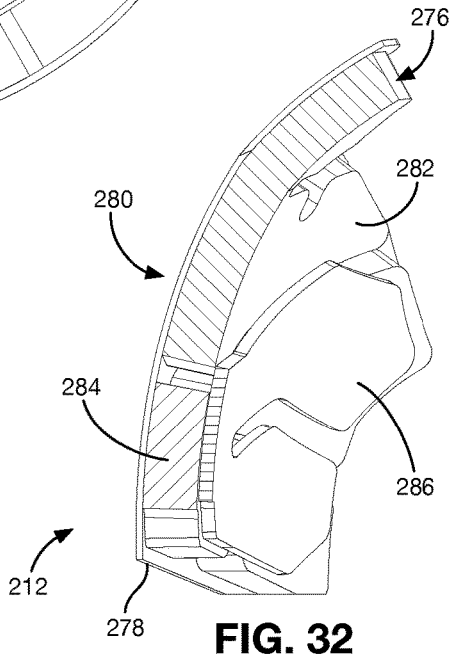
FIG. 32 shows a cross-sectional view thereof.
Figure 33:
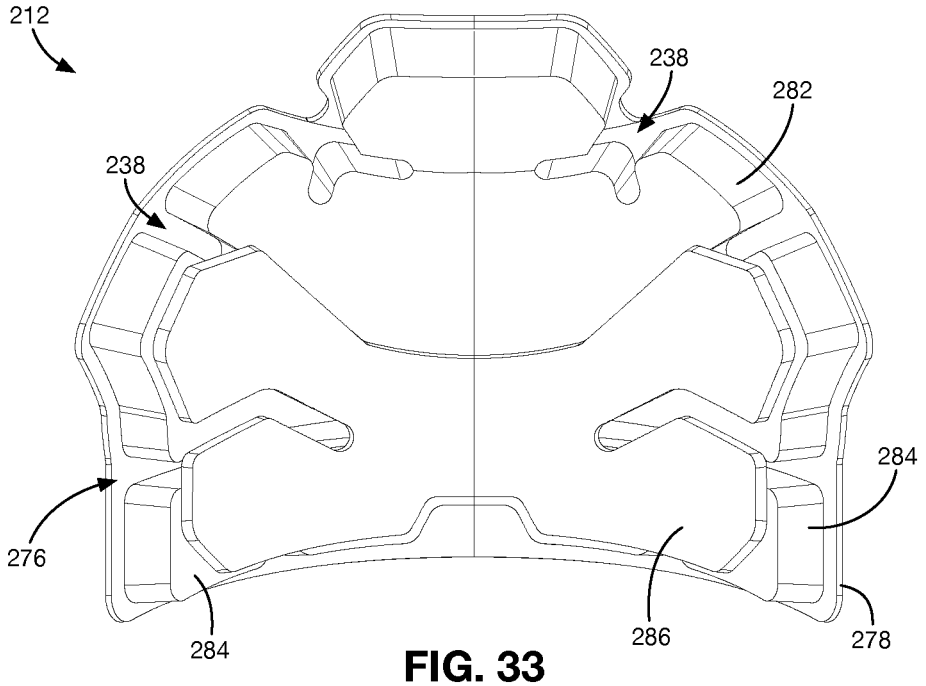
FIG. 33 shows a rear view thereof.
Figure 34:
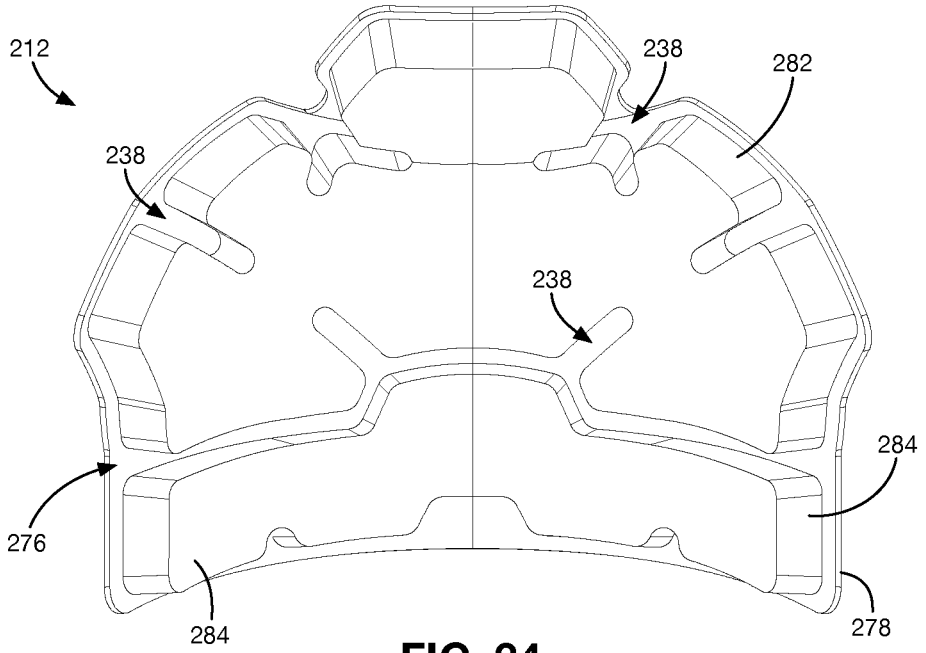
FIG. 34 shows a rear view thereof, without a comfort pad.
Figure 35:
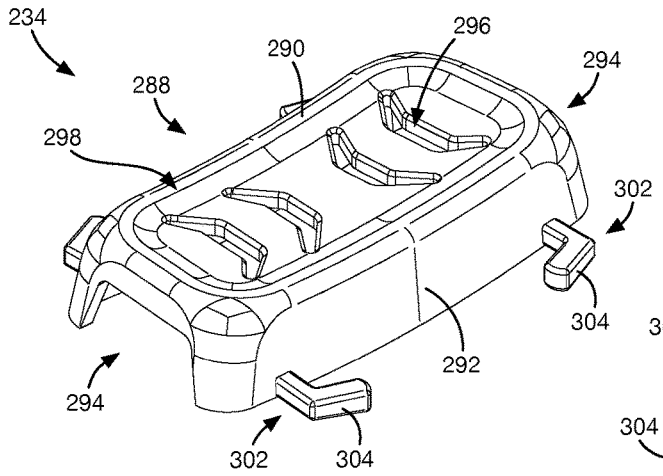
FIG. 35 shows a top perspective view of an insert for a helmet liner.
Figure 37:
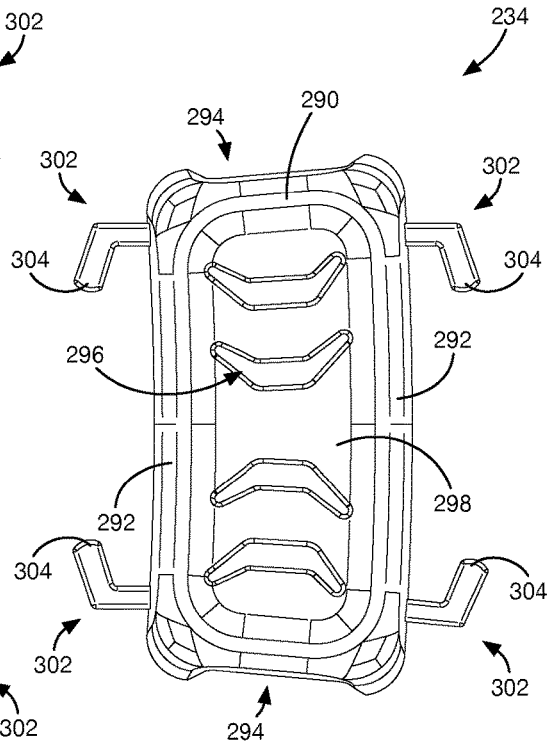
FIG. 37 shows a top view thereof.
Figure 36:
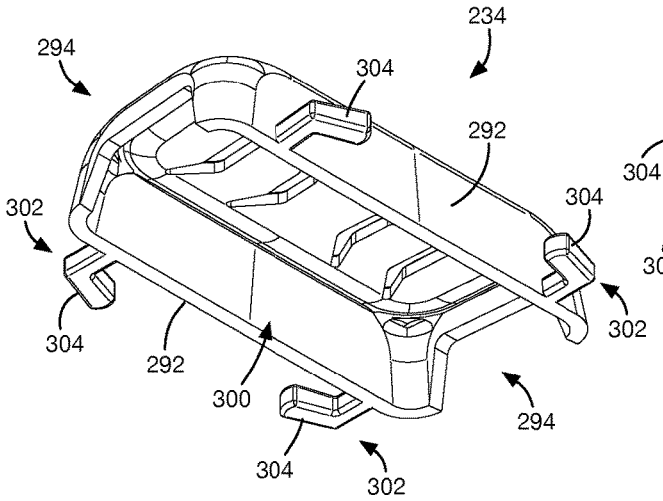
FIG. 36 shows a bottom perspective view thereof.
Figure 38:
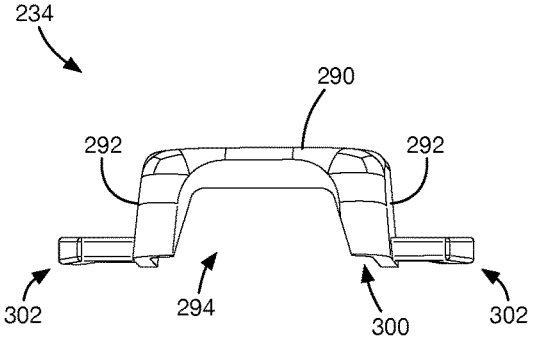
FIG. 38 shows a front view thereof.
Figure 39:
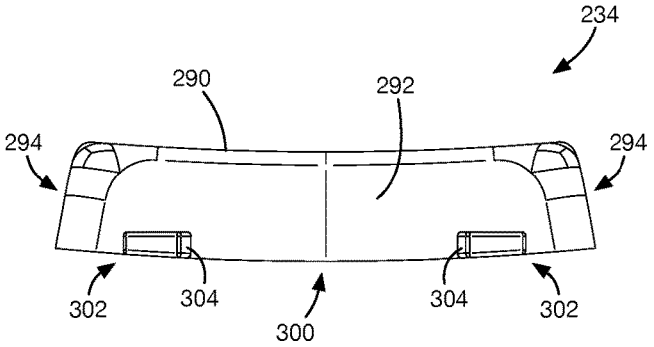
FIG. 39 shows a side view thereof.

Referring now to FIGS. 27-29, various views of the center pad assembly 210 are shown. As can be seen in FIG. 29, the center pad assembly 210 includes a plurality of impact pads 244 arranged on a first substrate 246 and a second substrate 248, thereby forming first and second sub-assemblies 250, 252 of the center pad assembly 210. An attachment surface 254 of the first substrate 246 includes one half of a hook-and-loop material (i.e., the hook or the loop side) for attaching the first sub-assembly 250 to the inner surface 206 of the helmet shell 202. The impact pads 244 of the first sub-assembly 250 include a left-side impact pad 256 and a right-side impact pad 258. The left and right side impact pads 256, 258 are arranged near the ends of the first substrate 246 that extend from one side 220 to the other side 220 of the helmet 200. The left and right side impact pads 256, 258 are configured to protect the sides of the head of the wearer. A side comfort pad 260 is attached to each of the left and right side impact pads 256, 258 and is softer and more flexible than the side impact pads 256, 258 to provide improved comfort to the wearer of the helmet 200.

Referring again to FIGS. 27 and 28, the relationship between the first and second sub-assemblies 250, 252 of the center pad assembly 210 can be seen. That is, the second sub-assembly 252 is arranged in a space between the left and right side impact pads 256, 258 of the first sub-assembly 250. An attachment surface 262 of the second sub-assembly 252 includes at least one half of a hook-and-loop material (i.e., the hook side, the loop side, or portions formed from each of the hook side and the loop side) for attaching the second sub-assembly 252 to the first substrate 246 of the first sub-assembly 250 and to the inner surface 206 of the helmet shell 202. Arranging the impact pads 244 of the center pad assembly 210 onto first and second substrates 246, 248 to form first and second sub-assemblies 250, 252 facilitates the maintenance of the desired spacing and orientation of the impact pads 244 during attachment of the center pad assembly 210 to the helmet shell 202.

The impact pads 244 of the second sub-assembly 252 include left and right front corner impact pads 264, 266, left and right rear corner impact pads 268, 270, and a crown impact pad 272. The crown impact pad 272 can be removeably attached to the second substrate 248 of the second sub-assembly 252 so that the crown impact pad 272 can be installed after the installation of the first sub-assembly 250 and of the second substrate 248 and attached corner impact pads 264, 266, 268, 270. That is, an attachment surface 274 of the crown impact pad 272 can include one half of a hook-and-loop fastener and the second substrate 248 can include the other half of the hook-and-loop fastener. The corner impact pads 264, 266, 268, 270 and/or the crown impact pad 272 can include one or more comfort pads (not shown) that attach to one or more of corner impact pads 264, 266, 268, 270 and the crown impact pad 272.

The left and right side impact pads 256, 258, the left and right front corner impact pads 264, 266, the left and right rear corner impact pads 268, 270, and the crown pad 272 can be configured to resist different impact forces. For example, left and right side impact pads 256, 258 can be more flexible and/or thinner than the corner impact pads 264, 266, 268, 270 and the crown impact pad 272. The corner impact pads 264, 266, 268, 270 and the crown impact pad 272 can also be formed from a more dense material than the left and right side impact pads 256, 258. For example, the corner impact pads 264, 266, 268, 270 and the crown impact pad 272 can be formed from a polyurethane foam having a density of about 14 pounds per cubic foot and the left and right side impact pads 256, 258 can be formed from a polyurethane foam having a density of about 4 pounds per cubic foot. As another example, the left and right front corner impact pads 264, 266 can be thinner than the left and right rear corner impact pads 268, 270 and can be formed from the same or a more or less flexible material. Forming the left and right side impact pads 256, 258 and/or the left and right front corner impact pads 264, 266 from a less dense, thinner, and/or less stiff material reduces the overall weight of the liner 204 while still allowing for resistance of impacts up to 14 feet per second via the remaining impact pads 244 of the center pad assembly 210—i.e., the corner impact pads 264, 266, 268, 270 and the crown pad 272. The impact pads 244 of the center pad assembly 210 can include optional cutouts (not shown) similar to the cutouts 238 in the front impact pad 230. During compression, the foam of the impact pads 244 can deform into the cutouts, thereby softening the impact pads 244 in the area of the cutouts. The space between the impact pads 244 form air channels 222 for providing ventilation and cooling to the wearer's head.

Referring now to FIGS. 30-34, various views of the rear pad assembly 212 are shown. The rear pad assembly 212 includes a plurality of impact pads 276 attached to a substrate 278. An attachment surface 280 of the substrate 278 includes one half of a hook-and-loop material (i.e., the hook or the loop side) for attaching the rear pad assembly 212 to the inner surface 206 of the helmet shell 202. The impact pads 276 of the rear pad assembly 212 include a rear impact pad 282 arranged above and spaced apart from a nape impact pad 284. The space between the rear impact pad 282 and the nape impact pad 284 forms an air channel 222 for providing ventilation and cooling to the wearer's head. The rear impact pad 282 is configured to protect the back of the wearer's head and the nape impact pad 284 is configured to protect the nape of the wearer's head. Arranging the impact pads 276 on a shared substrate 278 enables the entire rear pad assembly 212 to be installed into the helmet shell 202 in one operation while also maintaining a proper spacing and orientation of the impact pads 276.

Figure 22:
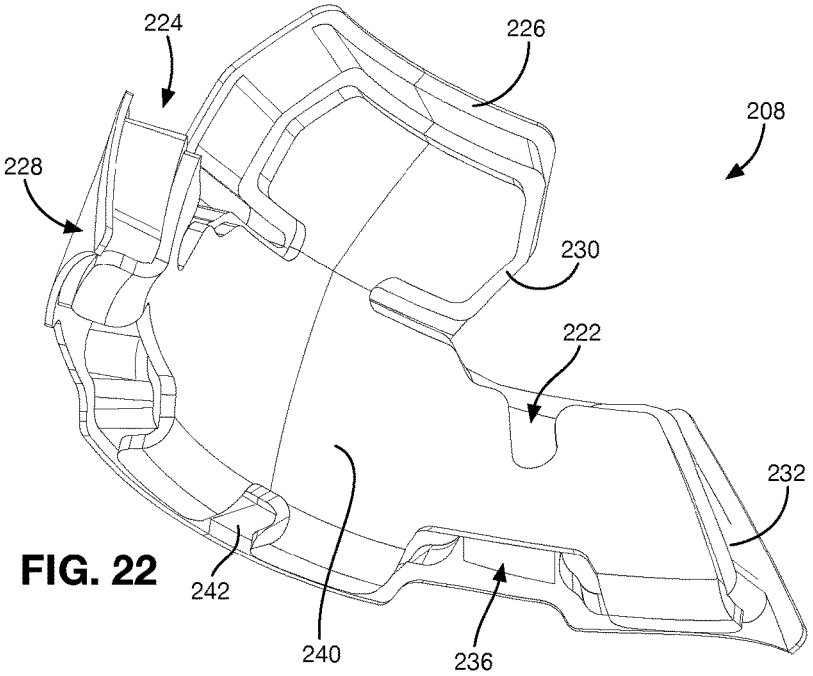
FIG. 22 shows a bottom-rear perspective view of a front pad assembly.
Figure 23:
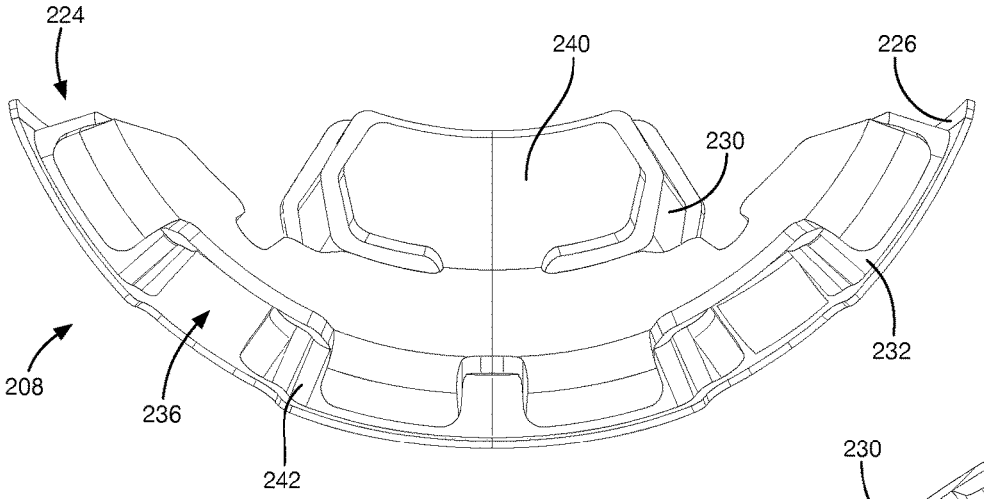
FIG. 23 shows a bottom view thereof.
Figure 24:
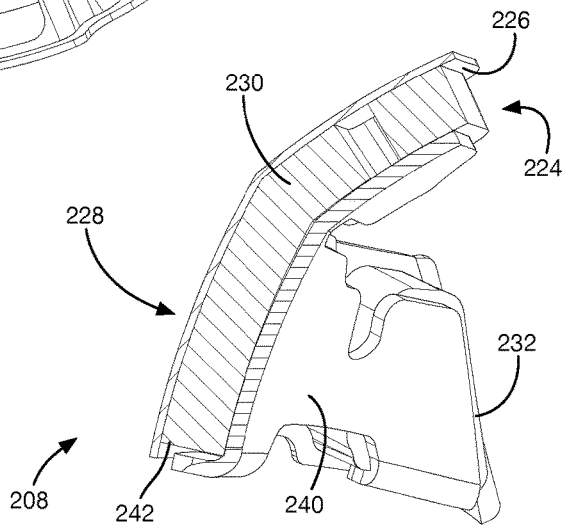
FIG. 24 shows a cross-sectional view thereof.
Figure 25:
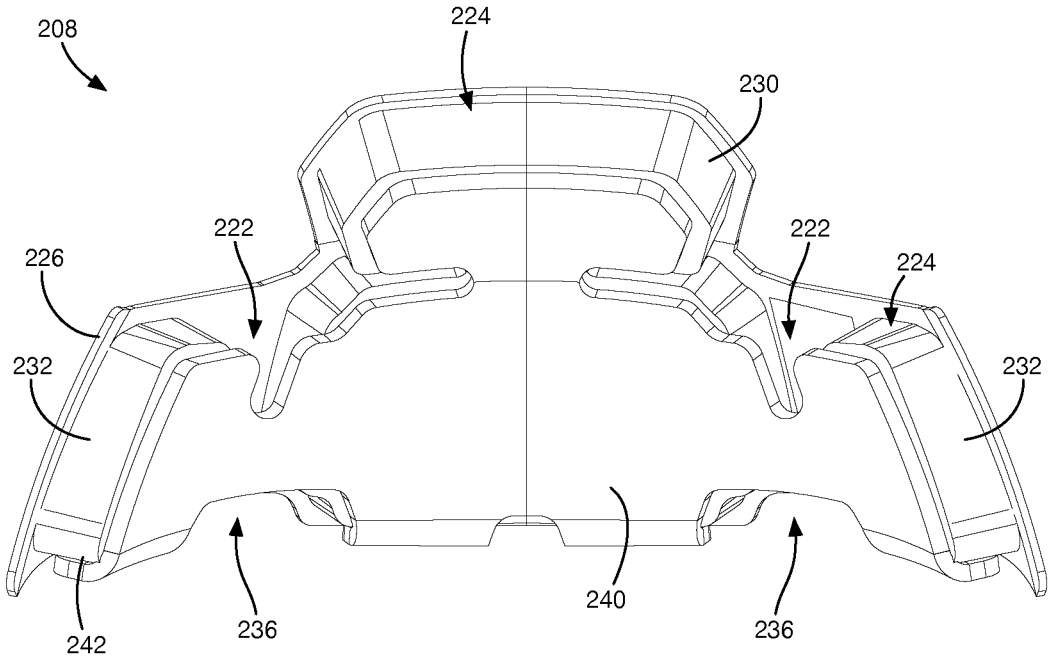
FIG. 25 shows a rear view thereof.

The rear impact pad 282 and the nape impact pad 284 can be configured to resist different impact forces. For example, the front rear impact pad 282 can be more stiff and/or thicker than the nape impact pads 284. The rear impact pad 282 can also be formed from a more dense material than the nape impact pad 284. For example, the rear impact pad 282 can be formed from a polyurethane foam having a density of about 14 pounds per cubic foot and the nape impact pad 284 can be formed from a polyurethane foam having a density of about 4 pounds per cubic foot. Forming the nape impact pad 284 from a less dense, thinner, and/or less stiff material reduces the overall weight of the liner 204 while still allowing for resistance of impacts up to 14 feet per second via the rear impact pad 282. As can be seen in FIG. 22, the rear impact pad 282 can include optional cutouts 238. During compression, the foam of the rear impact pad 282 can deform into the cutouts 238, thereby softening the rear impact pad 282 in the area of the cutouts 238.

The rear pad assembly 212 also includes a rear comfort pad 286 that covers at least a portion of each of the rear impact pad 282 and the nape impact pad 284. In the illustrated embodiment, the rear comfort pad 286 extends across the air channel 222 formed between the nape impact pads 284 and the rear impact pad 282. The rear comfort pad 286 is formed from a softer material than the rear impact pad 282 and the nape impact pad 284 to provide improved comfort for the wearer.

The impact pads 224, 244, 276 in each of the pad assemblies 208, 210, 212 can be attached to their respective substrates 226, 246, 248, 278 in a wide variety of ways, such as, for example, with a hook-and-loop fastener, an adhesive, heat bonding, stitching, or the like. That is, the impact pads 224, 244, 276 can be fixedly or removably attached to their respective substrates 226, 246, 248, 278. While the impact pads 224, 244, 276 described herein are shown attached to the inner surface 206 of the helmet shell 202 indirectly—i.e., via substrates 226, 246, 248, 278—any number of the impact pads can also be directly attached to the interior surface 206.

Figure 14:
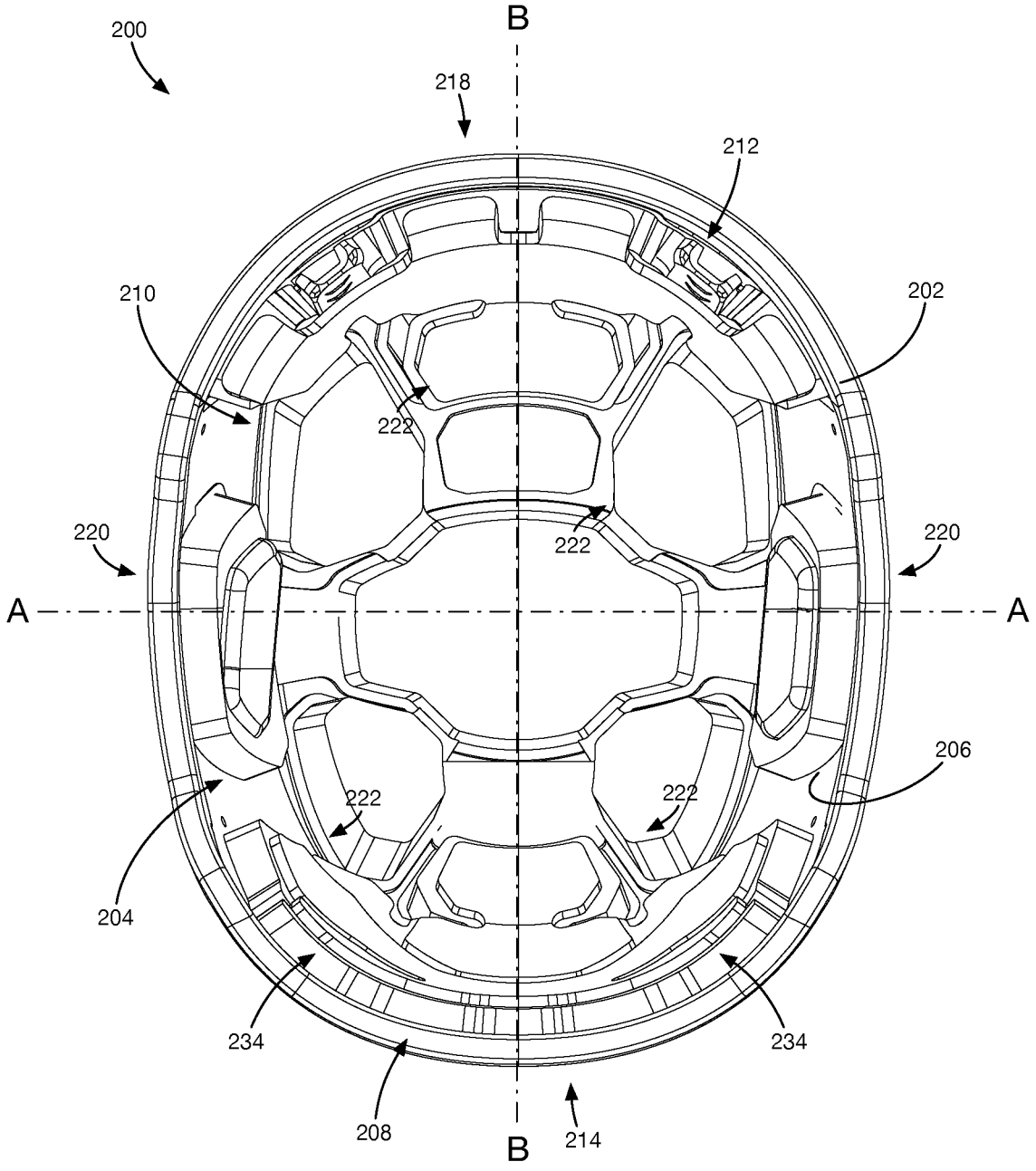
FIG. 14 shows a bottom view of the helmet and liner thereof.
Figure 15:
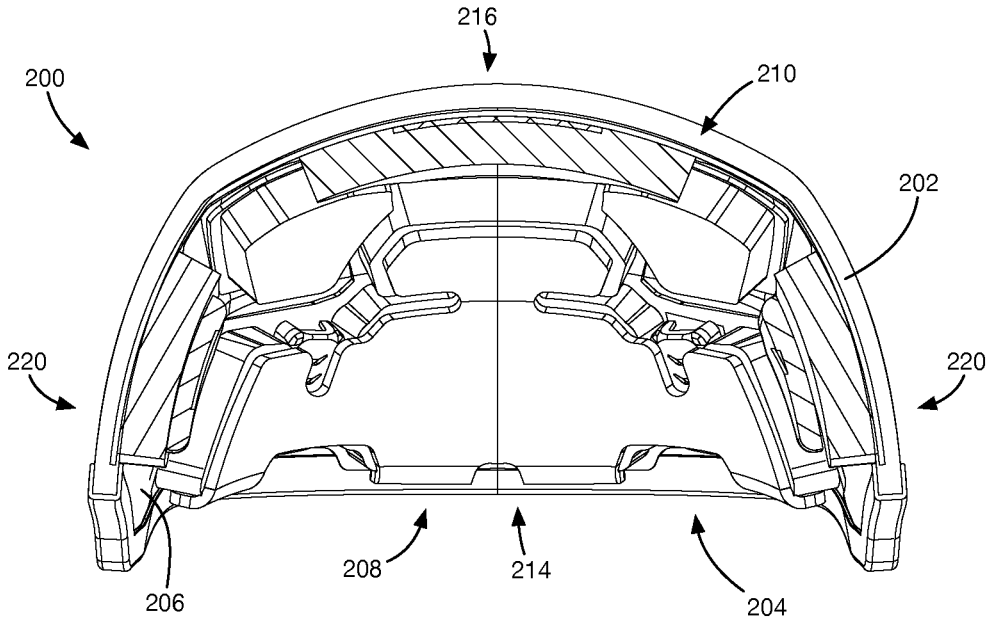
FIG. 15 shows a front-facing cross-sectional view of the helmet and liner thereof taken along the line A-A of FIG. 14.
Figure 16:
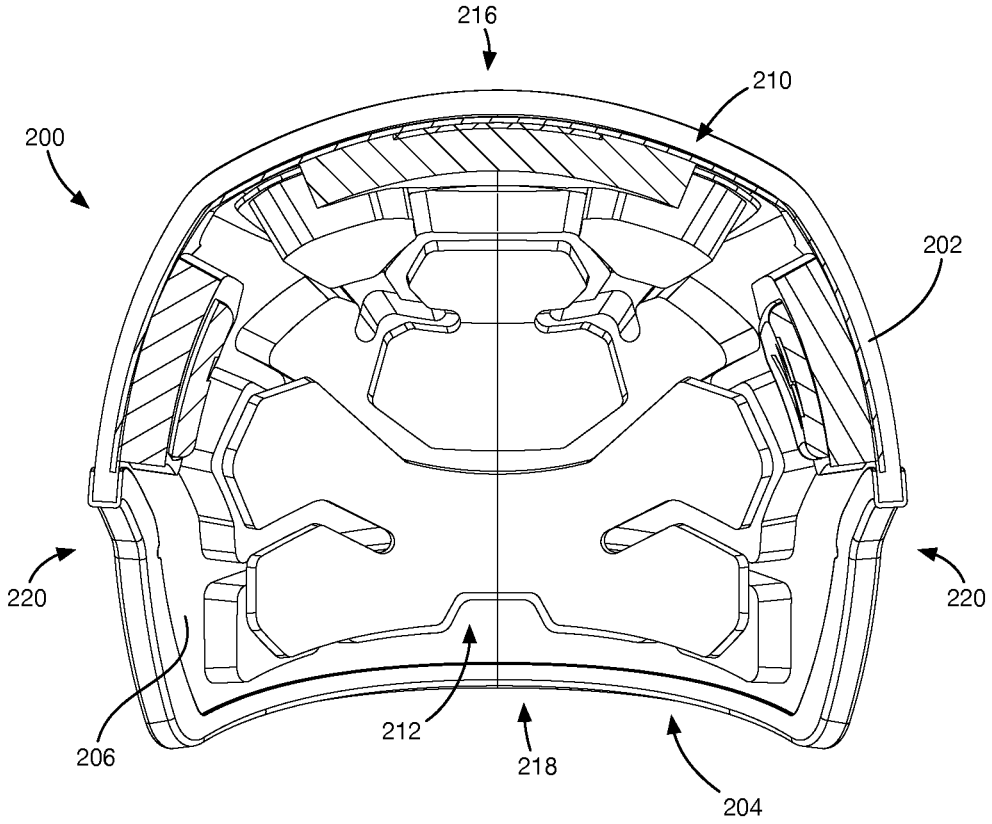
FIG. 16 shows a rear-facing cross-sectional view of the helmet and liner thereof taken along the line A-A of FIG. 14.
Figure 17:
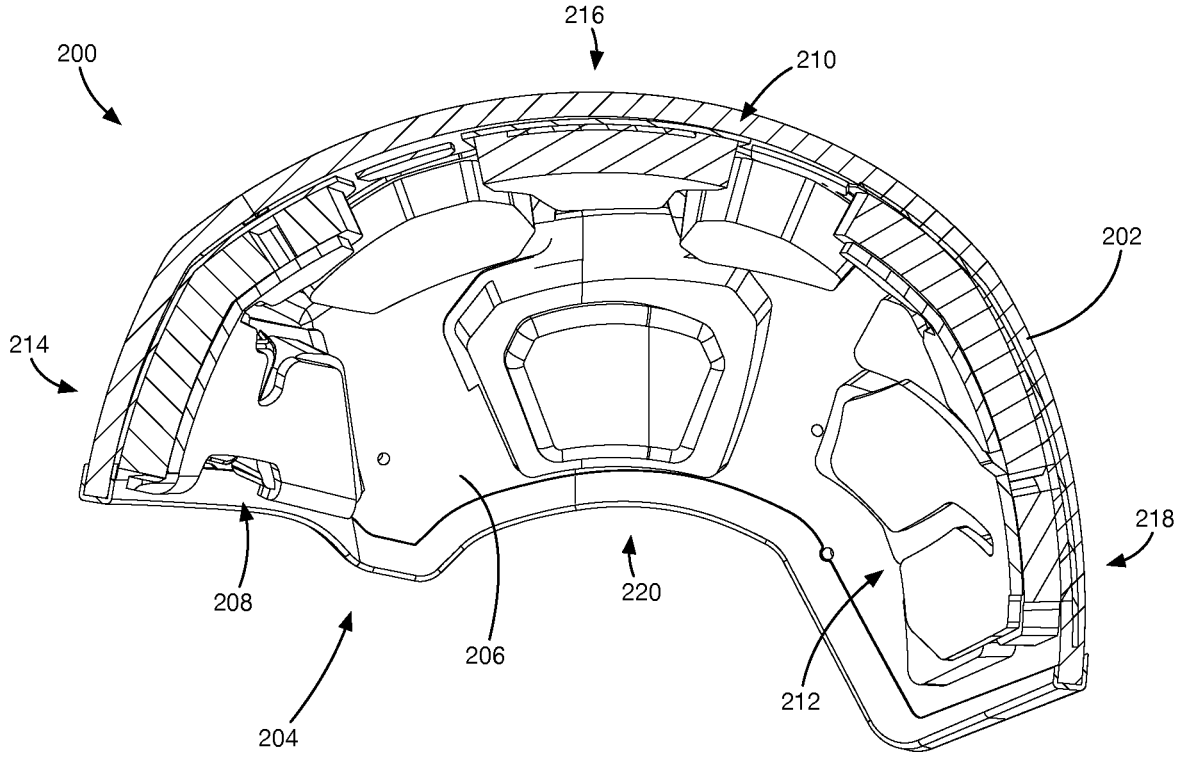
FIG. 17 shows a cross-sectional view of the helmet and liner thereof, taken along the line B-B of FIG. 14.
Figure 18:
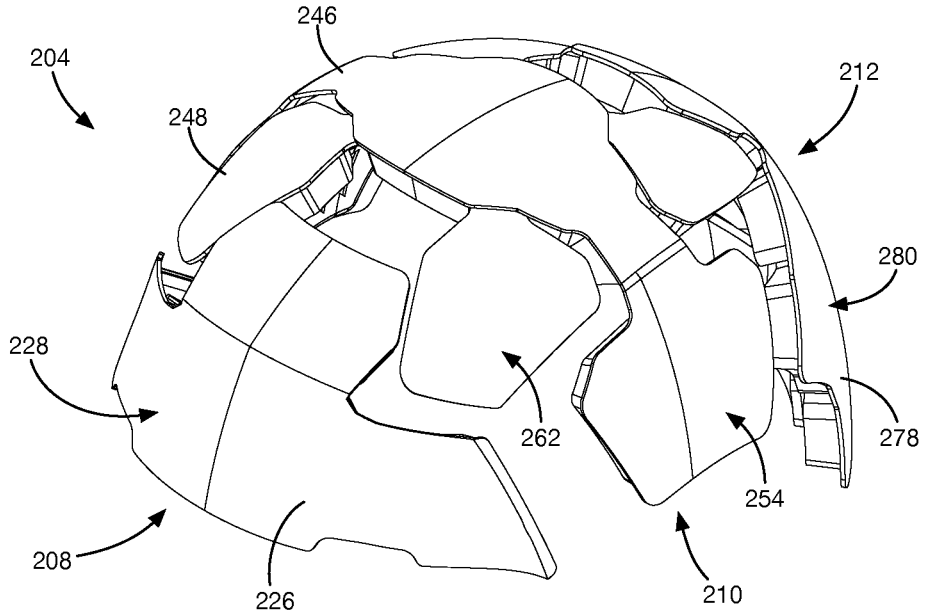
FIG. 18 shows a top perspective view of the liner of FIG. 13 removed from the helmet shell.
Figure 19:
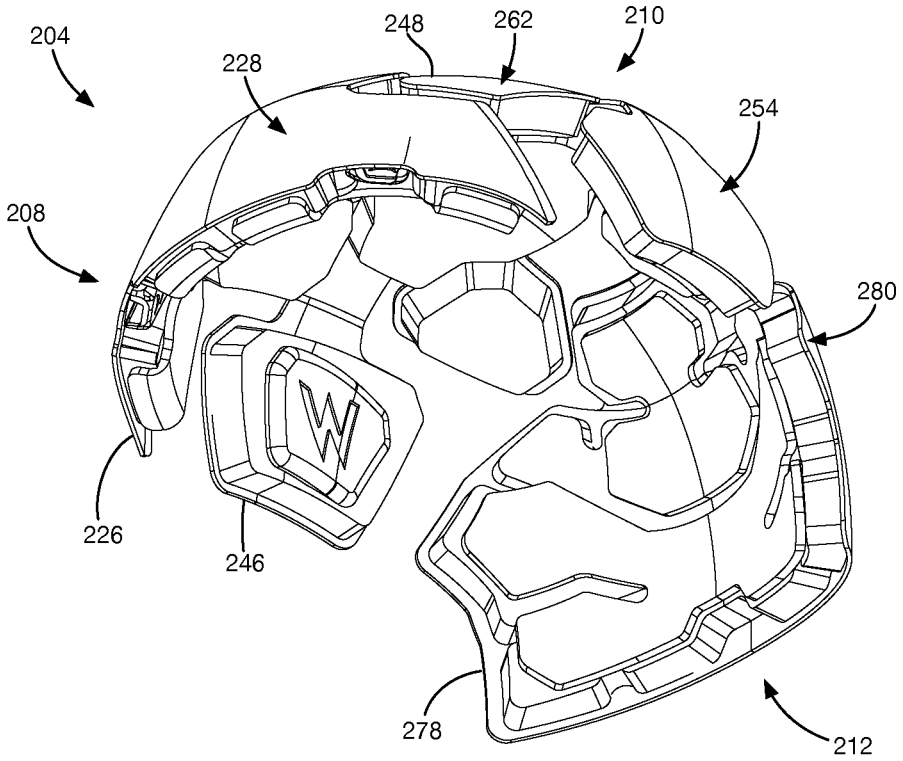
FIG. 19 shows a bottom perspective view thereof.
Figure 20:
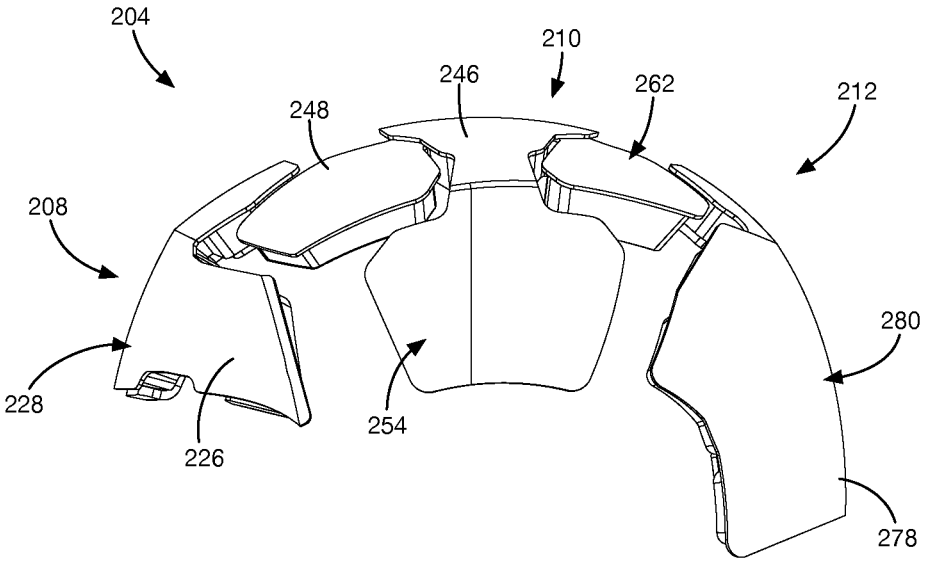
FIG. 20 shows a side view thereof.
Figure 21:
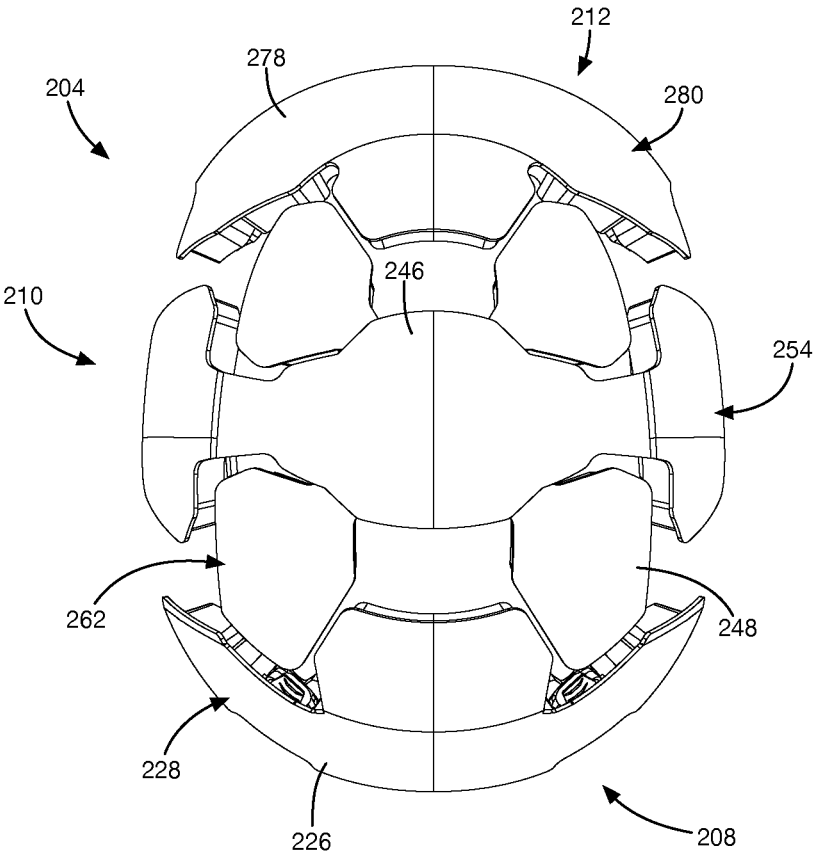
FIG. 21 shows a top view thereof.

Referring now to FIGS. 35-41, various views of inserts—such as the inserts 234 described herein—are shown. As was described above, the inserts 234 can be placed in air channels 222 of the liner 204, such as the air channels 222 formed between the front impact pad 230 and the temple impact pads 232. The inserts 234 prohibit at least a portion of the air channels 222 from collapsing when the helmet 200 is worn on a wearer's head. For example, any one or more edges of the front impact pad 230 or temple impact pads 232 may collapse into the air channel 222 when the user's head (e.g., the user's forehead) is pressed against the front pad assembly 208. Air channels 222 that can receive an insert 234, as can be seen in FIG. 14, are formed between impact pads 224, 244, 276, comfort pads 240, 260, 286, and pad assemblies 208, 210, 212.

The inserts 234 can be formed from any material that is light weight and provides enough strength and rigidity to resist the pressure applied by adjacent impact pads under compression. Suitable materials include, but are not limited to, or example, the inserts 234 can be formed by any suitable manufacturing technique (e.g., injection molding) from thermoplastic urethane (TPU), polypropylene, polyethylene, ABS plastic, rubber, ethylene propylene diene Monomer (M-class) rubber (EPDM), and the like. The inserts 234 can also be formed via additive manufacturing—e.g., 3D printing—in their illustrated form or as a lattice configured to resist compression and provide sufficient airflow for ventilation. The size of the lattice openings can be adjusted according to the airflow and compression requirements.

Referring now to FIGS. 35-41, various views of exemplary inserts 234 are shown. The inserts 234 include a body portion 288 that has an top wall or surface 290 extending between two side walls 292. The insert 234 is open at the ends 294 to provide airflow through the insert 234 between the ends 294. Openings 296 in the top wall 290 of the insert 234 also facilitate air flow through the insert 234. The top wall 290 can include an indentation 298 that provides additional rigidity to the insert 234 and additional space for air to flow between the insert 234 and a comfort pad 240, 260, 286 or the wearer's head. A bottom 300 of the insert 234 is open and is closed off by the inner surface 206 of the helmet shell 202 and/or a substrate of the pad assemblies 208, 210, 212. As can be seen most clearly in FIG. 37 and FIG. 39, the insert 234 can be formed with a curved shape to conform to the curvature of the interior surface 206 of the helmet shell 202. The insert 234 can also be flexible or include features that permit the insert of flex.

Figure 40:
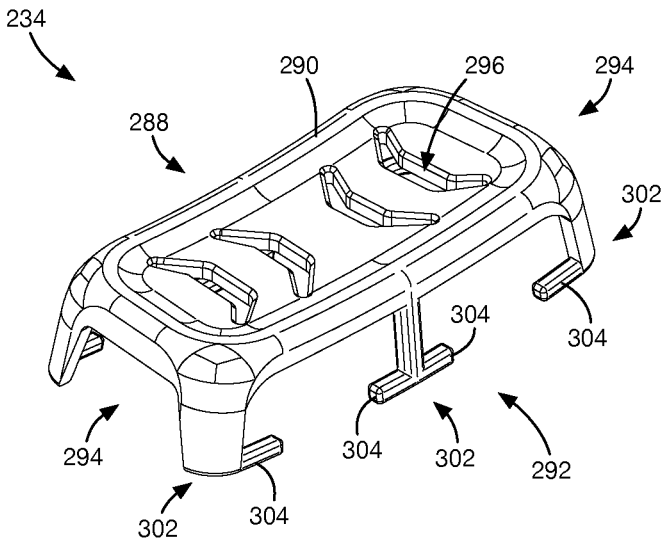
FIG. 40 shows a top perspective view of another insert for a helmet liner.
Figure 41:
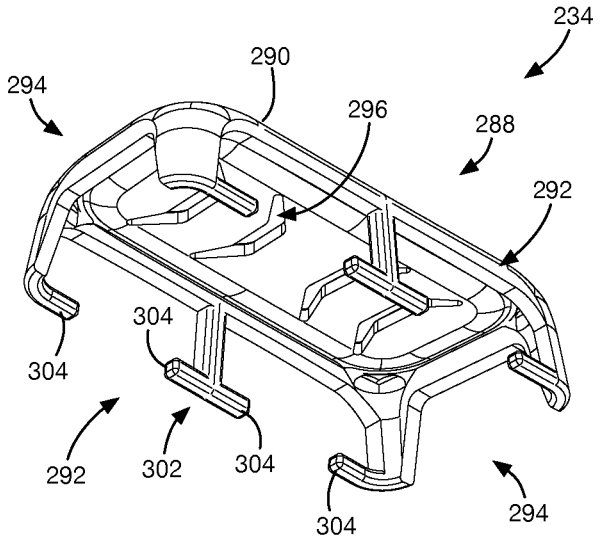
FIG. 41 shows a bottom perspective view thereof.

Attachment members 302 extend outward from the side walls 292 of the insert 234 and can optionally include hook portions 304. The attachment members 302 can fit between a pad and a substrate of a pad assembly 208, 210, 212 to hold the insert 234 in position. The attachment members 302 form a mechanical connection that can be overcome by pulling the inserts 234 away from the liner 204 so that, for example, a space can be cleared for the strap or buckle of an APR. The attachment members 302 can also form or be integrally formed with other portions of the insert 234. For example, as is shown in FIGS. 40-41, side walls 292 of the insert 234 are formed by attachment members 302 and hook portions 304 so that most of the side walls 292 are open to permit air flow.

Figure 42:
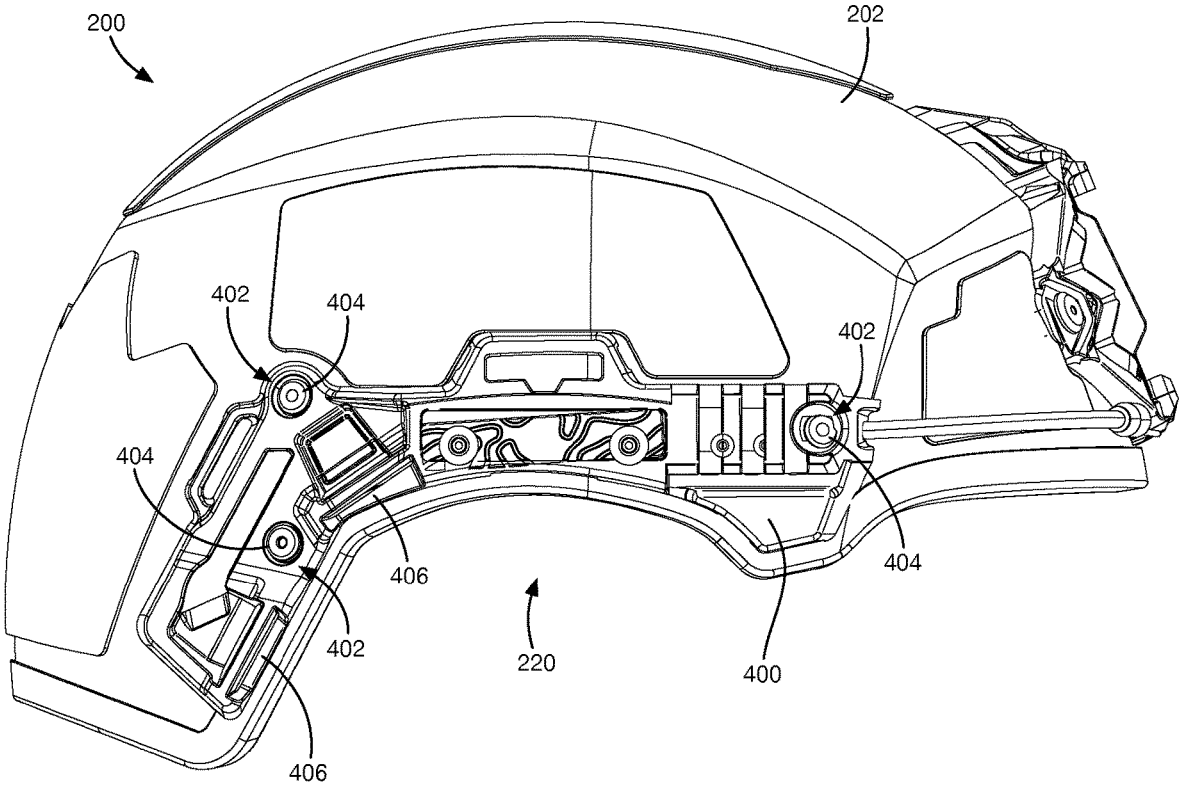
FIG. 42 shows a side view of an exemplary helmet with an accessory attachment rail.
Figure 43:
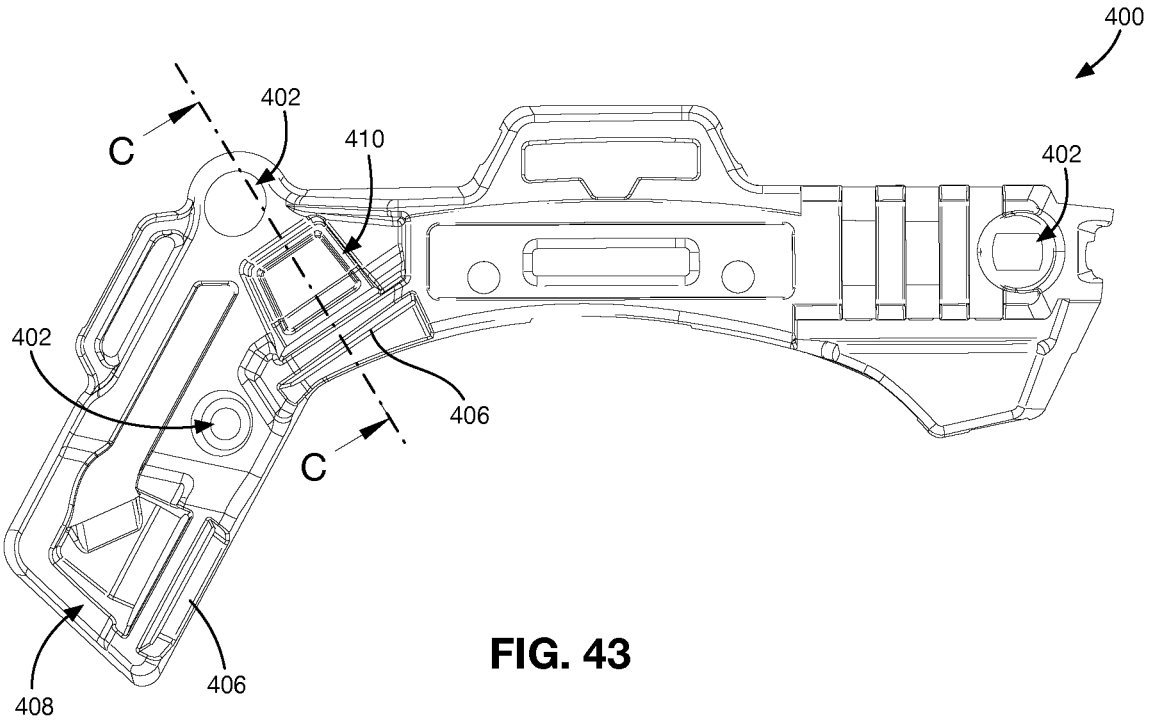
FIG. 43 shows a side view of the accessory attachment rail separated from the helmet.
Figure 44:
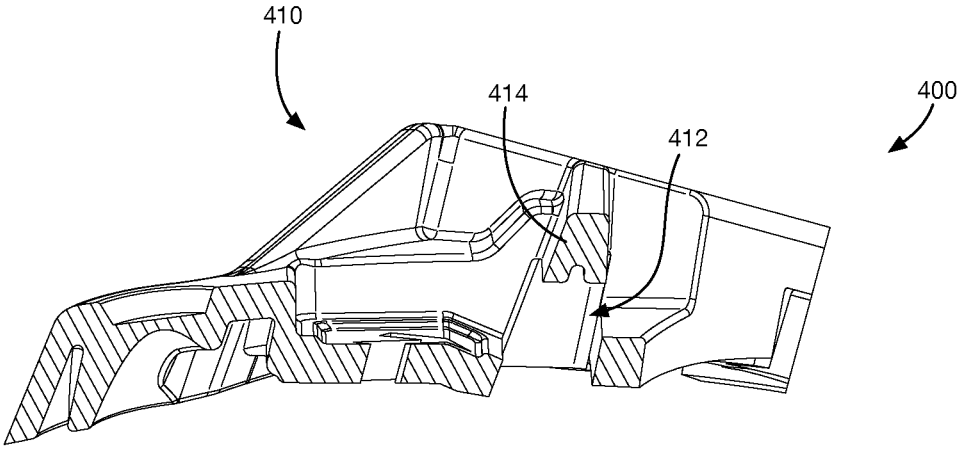
FIG. 44 shows a cross-sectional view of a mounting point thereof, taken along the line C-C in FIG. 43.

Referring now to FIGS. 42-44, the helmet 200 is shown with side and front mounting features for attaching accessories to the helmet shell 202. In particular, the helmet 200 includes an accessory mount or rail 400 that can be secured to a side 220 of the helmet shell 202. The accessory mount 400 includes fastener holes 402 for receiving fasteners 404 used to secure the accessory mount 400 to the helmet shell 202. The accessory mount 400 also includes various features for attaching accessories to the helmet 200. In particular, the accessory mount 400 includes two clip-in mounts 406 for receiving a buckle secured to a strap of, for example, an APR, an oxygen mask, or other face covering or respirator.

The clip-in mounts 406 are provided at two locations along the accessory mount 400 to facilitate use of the helmet 200 in a wide variety of scenarios. One of the clip-in mounts 406 is arranged a first position 408 that is behind the ear of the wearer. The other clip-in mount 406 is arranged in a second position 410 that is in a corner of the accessory mount 400 that is above and behind the ear of the wearer. Providing the clip-in mounts 406 in first and second positions 408, 410 enables a more secure attachment of, for example, a mandible or ear cover that engages the full ear cut-away area of the helmet shell 202. Two clip-in mounts 406 provide a firm and secure engagement between such an accessory and the accessory mount 400 while also allowing the same helmet 200 to be used with accessories (e.g., oxygen masks or respirators) that benefit from attaching to the clip-in mount 406 in the second position 410.

Referring now to FIG. 44, a cross-sectional view of one of the clip-in mounts 406 is shown. The clip-in mount 406 includes an opening 412 for receiving a buckle (see FIG. 45) of an accessory. Once the buckle is inserted through the opening 412, a catch (see FIG. 45) of the buckle is allowed to move into a locked position against a locking bar 414 of the clip-in mount 406 to prohibit disassembly of the buckle from the clip-in mount 406. Both of the clip-in mounts 406 of the accessory mount or rail 400 are "full size" clip-in mounts 406 that do not require new buckles for attachment or different buckles for clip-in mounts 406 in the first and second positions 408, 410.

Figure 45:
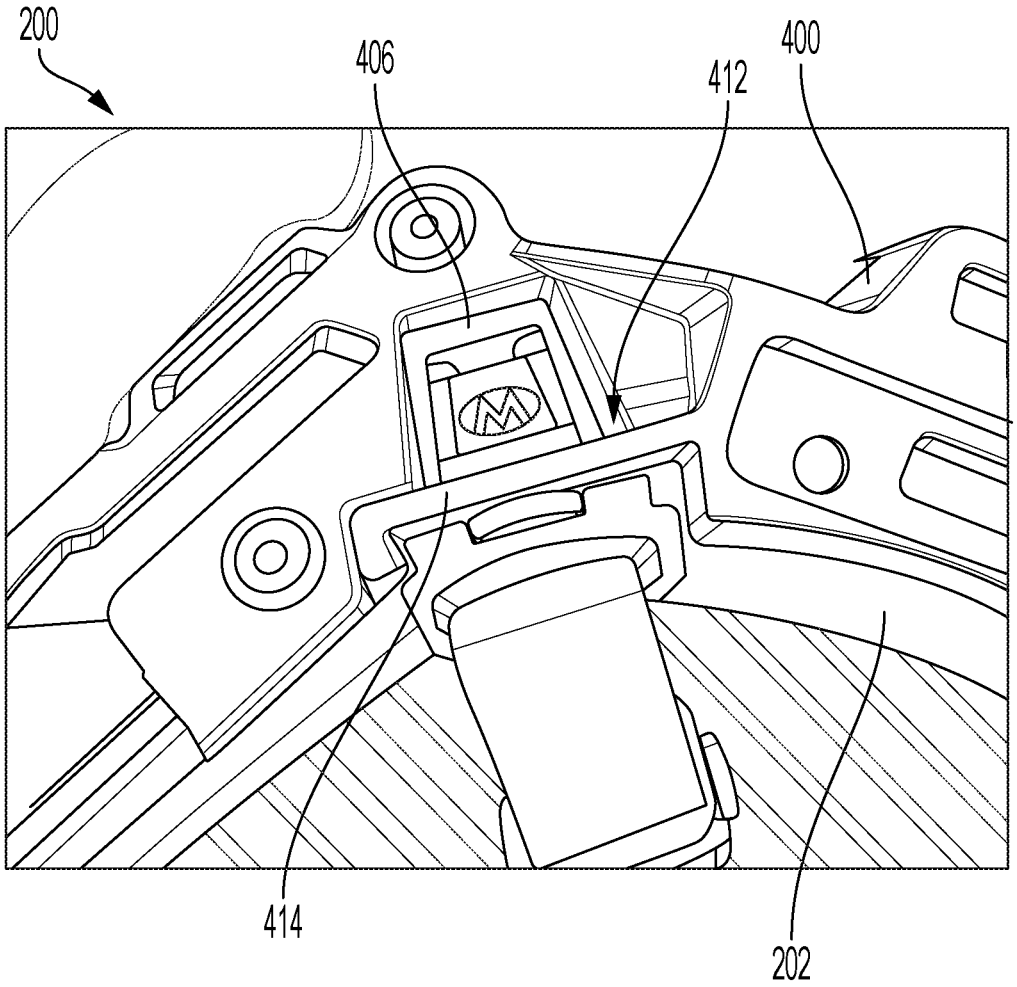
FIG. 45 is a photo of a buckle attached to the accessory attachment rail.

Referring now to FIG. 45, a buckle is shown clipped into one of the clip-in mounts 406 of the accessory mount 400. The buckle is inserted through the opening 412 of the clip-in mount 406 until the catch of the buckle is allowed to move into the locked position against the locking bar 414 of the clip-in mount 406.

An example of a helmet includes a shell and a liner attached to the shell. The liner has a first impact pad, a second impact pad, and a comfort pad. A density of the first impact pad is greater than a density of the second impact pad and the comfort pad is removeably attached to the first impact pad and the second impact pad.

In an example of the helmet, the density of the first impact pad is in a range of 8 pounds per cubic foot to 18 pounds per cubic foot.

In an example of the helmet, the density of the first impact pad is 4 pounds per cubic foot.

In an example of the helmet, the density of the second impact pad is in a range of 3 pounds per cubic foot to 13 pounds per cubic foot.

In an example of the helmet, the density of the first impact pad is 14 pounds per cubic foot.

In an example of the helmet, wherein the liner comprises a front pad assembly, a center pad assembly, and a rear pad assembly.

In an example of the helmet, the front pad assembly comprises a front impact pad and temple impact pads spaced apart from the front impact pad.

In an example of the helmet, wherein the front impact pad has a density of 14 pounds per cubic foot.

In an example of the helmet, the temple impact pads have a density of 4 pounds per cubic foot.

In an example of the helmet, the front pad assembly comprises a comfort pad that extends around a bottom edge of the front pad assembly.

In an example of the helmet, the front pad assembly comprises a comfort pad that is attached to both the front impact pad and the temple impact pads.

In an example of the helmet, the front impact pad and the temple impact pads are attached to a substrate.

In an example of the helmet, the helmet includes an insert arranged in an air channel formed between the front impact pad and one of the temple impacts pads.

In an example of the helmet, the rear pad assembly comprises a rear impact pad and a nape impact pad spaced apart from the rear impact pad.

In an example of the helmet, the rear impact pad has a density of 14 pounds per cubic foot.

In an example of the helmet, the nape impact pad has a density of 4 pounds per cubic foot.

In an example of the helmet, the rear pad assembly comprises a comfort pad that is attached to both the rear impact pad and the nape impact pad.

In an example of the helmet, the center pad assembly comprises a crown pad, corner impact pads, and side impact pads.

In an example of the helmet, the center pad assembly comprises a first sub-assembly comprising a first substrate and the side impact pads.

In an example of the helmet, the center pad assembly comprises a second sub-assembly comprising a second substrate, the crown impact pad, and the corner impact pads.

An example of a helmet includes a shell having an ear cut-away that provides clearance for the wearer's ear and an accessory mount arranged above and adjacent to the ear cut-away. The accessory mount has a pair of clip-in mounts arranged in first and second positions: the first position is arranged behind the wearer's ear; and the second position is arranged above and behind the wearer's ear.

In an example of the helmet, each clip-in mounts each comprise an opening for receiving a buckle and a locking bar for retaining a catch of the buckle.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, alternatives as to form, fit, and function, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein.

Additionally, even though some features, concepts, or aspects of the disclosures may be described herein as being a preferred arrangement or method, such description is not intended to suggest that such feature is required or necessary unless expressly so stated. Still further, exemplary, or representative values and ranges may be included to assist in understanding the present application, however, such values and ranges are not to be construed in a limiting sense and are intended to be critical values or ranges only if so expressly stated.

Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. A helmet comprising:

a shell formed from a first shell material, wherein the shell comprises a recess extending into the shell to a support surface of the shell, wherein the recess has a depth between an outer surface of the shell and the support surface of the shell; and a shell insert formed from a second shell material, the shell insert having a shape corresponding to a shape of the recess and a thickness equal to the depth of the recess, wherein the shell insert is attached at least to the support surface of the recess;

wherein the shell is configured to receive a liner; and wherein the first shell material has a first stiffness that is less than a second stiffness of the second shell material.

2. The helmet of claim 1, wherein the recess comprises a sidewall that extends around a perimeter of the recess.

3. The helmet of claim 1, further comprising:

a first internal surface of the shell;

a second internal surface of the shell that is spaced apart from the first internal surface of the shell; and an internal shell insert, wherein the internal shell insert comprises a recess having a sloped perimeter, the recess having a depth that corresponds to a distance between the first internal surface and the second internal surface.

4. The helmet of claim 3, wherein the second internal surface has a shape that corresponds to the shape of the recess in the helmet shell.

5. The helmet of claim 4, wherein the first shell material is polycarbonate, the second shell material is carbon fiber, and the third shell material is expanded polypropylene foam.

6. The helmet of claim 3, wherein the internal shell insert is formed from a third shell material, and wherein the third shell material has a density that is less than a density of the first shell material.

7. The helmet of claim 3, wherein the support surface of the recess in the helmet shell comprises an opening.

8. The helmet of claim 7, wherein the internal shell insert comprises a raised area having a shape that corresponds to a shape of the opening, wherein the raised area extends to and corresponds to a shape of the shell insert.

9. The helmet of claim 3, wherein at least one of the shell insert and the internal shell insert is attached to the helmet shell via an adhesive.

10. The helmet of claim 1, further comprising a coating covering the helmet shell.

11. The helmet of claim 1, further comprising a coating covering the helmet shell and the shell insert.

12. The helmet of claim 1, further comprising a first coating covering the helmet shell and a second coating covering the shell insert.

13. The helmet of claim 1, wherein the recess is formed in a crown of the shell.

14. The helmet of claim 13, wherein the recess has a width that widens and then narrows as the recess extends toward a rear of the shell.

15. The helmet of claim 13, wherein the recess includes a pair of laterally extending lobes.

16. The helmet of claim 1, wherein the first shell material is polycarbonate and the second shell material is carbon fiber.

17. A helmet comprising:

a shell formed from a first shell material, wherein the shell comprises a recess extending into the shell to a support surface of the shell, the recess including a sidewall that extends around a perimeter of the recess;

a shell insert formed from a second shell material, the shell insert having a shape corresponding to a shape of the recess and a thickness equal to a height of the sidewall of the recess, wherein the shell insert is attached at least to the support surface of the recess; and an internal shell insert formed from a third shell material, the internal shell insert having a recess corresponding to a shape of a raised surface of an interior surface of the helmet shell, wherein shape the raised surface corresponds to the shape of the recess in the helmet shell;

wherein the shell is configured to receive a liner;

wherein the first shell material has a first stiffness that is less than a second stiffness of the second shell material; and wherein the third shell material has a third stiffness that is less than the first stiffness and the second stiffness.

18. The helmet of claim 17, wherein the first shell material is polycarbonate, the second shell material is carbon fiber, and the third shell material is expanded polypropylene foam.

19. A composite helmet shell comprising:

a front, a rear, a left side, a right side, and a crown formed from a single piece of a first shell material, wherein at least the crown comprises a recess; and a shell insert formed from a second shell material, the shell insert having a shape corresponding to a shape of the recess in the crown of the shell;

wherein the shell is configured to receive a liner.

20. The composite helmet shell of claim 19, wherein:

the first shell material has a first density that is less than a second density of the second shell material; and the first material has a first stiffness that is less than a second stiffness of the second material.

* * * * *